US011645962B2

(12) United States Patent
Li

(10) Patent No.: US 11,645,962 B2
(45) Date of Patent: May 9, 2023

(54) COMMON ELECTRODE PATTERN, DRIVING METHOD, AND DISPLAY EQUIPMENT

(71) Applicant: HKC CORPORATION LIMITED, Guangdong (CN)

(72) Inventor: Zeyao Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/948,600

(22) Filed: Sep. 20, 2022

(65) Prior Publication Data

US 2023/0089652 A1 Mar. 23, 2023

(30) Foreign Application Priority Data

Sep. 23, 2021 (CN) ..... 202111117347.0

(51) Int. Cl.
*G09G 3/20* (2006.01)

(52) U.S. Cl.
CPC ..... *G09G 3/20* (2013.01); *G09G 2300/0426* (2013.01); *G09G 2310/0256* (2013.01); *G09G 2320/0233* (2013.01); *G09G 2320/0247* (2013.01)

(58) Field of Classification Search
CPC ..... G09G 3/20; G09G 2300/0426; G09G 2310/0256; G09G 2320/0233; G09G 2320/0247
See application file for complete search history.

(56) References Cited

U.S. PATENT DOCUMENTS

| | | | | |
|---|---|---|---|---|
| 2003/0095091 | A1 | 5/2003 | Enomoto et al. | |
| 2019/0295472 | A1* | 9/2019 | Yang | G09G 3/3291 |
| 2019/0295490 | A1* | 9/2019 | Kim | G09G 3/3696 |

FOREIGN PATENT DOCUMENTS

| | | | |
|---|---|---|---|
| CN | 103472605 | A | 12/2013 |
| CN | 203444220 | U | 2/2014 |
| CN | 107039013 | A | 8/2017 |
| CN | 107591143 | A | 1/2018 |
| CN | 110060642 | A | 7/2019 |
| CN | 113284470 | A | 8/2021 |
| TW | 200826035 | A | 6/2008 |

* cited by examiner

*Primary Examiner* — Sejoon Ahn

(74) *Attorney, Agent, or Firm* — Maier & Maier, PLLC

(57) ABSTRACT

A common electrode pattern, a driving method and a display equipment. By performing common voltage compensations for all positive-polarity pixels and all negative-polarity pixels through two common electrode units, respectively, the difference between the reduction degrees of the pixel potential of the display equipment at different refresh frequencies can be effectively reduced, so that the brightness of the screen displayed by the display equipment at different refresh frequencies tend to be consistent, thereby improving the phenomenon of screen flickering.

20 Claims, 11 Drawing Sheets

COMMON ELECTRODE PATTERN, DRIVING METHOD, AND DISPLAY EQUIPMENT

CROSS-REFERENCE TO THE RELATED APPLICATION

Pursuant to 35 U.S.C. § 119 and the Paris Convention, this application claims the benefit of Chinese Patent Application No. 202111117347.0 filed Sep. 23, 2021, the content of which is incorporated herein by reference.

TECHNICAL FIELD

The present application relates to the field of display technology, and more particularly to a common electrode pattern, a driving method, and a display equipment.

BACKGROUND

The statements provided herein are merely background information related to the present application, and do not necessarily constitute any prior arts. With continuous development of display technology, various types of display equipment emerge one after another, bringing great convenience to people's daily production, life and entertainment. Standard static refresh display equipment has a fixed refresh frequency, and a phenomenon of screen tearing occurs in case that the frame frequency of the graphics card is different from the refresh frequency of the display equipment. The frame synchronization (Free Sync) technology is to reduce the refresh frequency of the display equipment by increasing the vertical blank interval (Vertical Blank Interval, VBI) when the display equipment displays each frame, that is, prolonging the holding time of the pixel voltage of each pixel of the display equipment, so that the refresh frequency of the display equipment can be synchronized with the frame rate of the graphics card, thereby avoiding the phenomenon of screen tearing.

However, leakage will inevitably occur when maintaining a potential of the pixel after the pixel is charged, resulting in a decrease in potential. The display equipment will have different vertical blank intervals at different refresh frequencies due to the frame synchronization technology, resulting in different reduction degrees of the pixel potential, which will lead to different brightness of the screen under different refresh frequency, and even a phenomenon of screen flickering in severe cases.

SUMMARY

In view of this, embodiments of the present application provide a common electrode pattern, a driving method, and a display equipment. By performing common voltage compensations for all positive-polarity pixels and all negative-polarity pixels, through two common electrode units, respectively, the difference between the reduction degrees of the pixel potential of the display equipment at different refresh frequencies can be effectively reduced, thereby solving the problem that the display equipment has different vertical blank intervals at different refresh frequencies due to the frame synchronization technology, resulting in different reduction degrees of the pixel potential, which will lead to different brightness of the screen under different refresh frequency, or even a phenomenon of screen flickering in severe cases.

In accordance with a first aspect of this disclosure, a common electrode pattern is provided. The common electrode pattern includes a first common electrode unit and a second common electrode unit.

The first common electrode unit includes a first common electrode line and a plurality of second common electrode lines electrically connected to the first common electrode line. The first common electrode line is configured to be arranged along a first non-display area of an array substrate. The plurality of second common electrode lines are configured to be arranged according to an arrangement of all positive-polarity pixels in a display area of the array substrate, and to provide a common voltage for all the positive-polarity pixels.

The second common electrode unit includes a third common electrode line and a plurality of fourth common electrode lines electrically connected to the third common electrode line. The third common electrode line is configured to be arranged along a second non-display area of the array substrate. The plurality of fourth common electrode lines are configured to be arranged according to an arrangement of all negative-polarity pixels in the display area, and to provide a common voltage to all the negative-polarity pixels.

In accordance with a second aspect of this disclosure, a driving method sis provided, which is implemented based on the common electrode pattern provided in the first aspect of this disclosure, and the method includes the following steps:

acquiring a refresh frequency of a current frame; and adjusting the common voltage of all the positive-polarity pixels in a second vertical blank interval through a first common electrode unit, and adjusting the common voltage of all the negative-polarity pixels in the second vertical blank interval through the second common electrode unit, in case that the refresh frequency of the current frame is different from a refresh frequency of a reference frame, to enable a difference between a first voltage difference and a second voltage difference to be within a preset voltage-difference range.

The first voltage difference is a root mean square of differences between a common voltage and a pixel voltage of all pixels in a first vertical blank interval when the reference frame is displayed. The second voltage difference is a root mean square of differences between the common voltage and the pixel voltage of all the pixels in the second vertical blank interval when the current frame is displayed.

In accordance with a third aspect of this disclosure, a device for driving a pixel array is provided. The driving device includes a first acquisition unit and a first adjustment unit.

The first acquisition unit is configured to acquire a refresh frequency of a current frame.

The first adjustment unit is configured to adjust the common voltage of all the positive-polarity pixels in the second vertical blank interval through the first common electrode unit, and adjust the common voltage of all the negative-polarity pixels in the second vertical blank interval through the second common electrode unit, in case that the refresh frequency of the current frame is different from the refresh frequency of the reference frame, so that a difference between a first voltage difference and a second voltage difference is within a preset voltage-difference range.

The first voltage difference is a root mean square of differences between the common voltage and the pixel voltage of all pixels in the first vertical blank interval when the reference frame is displayed; the second voltage difference is a root mean square of differences between the common voltage and the pixel voltage of all the pixels in the second vertical blank interval when the current frame is displayed.

In accordance with a fourth aspect of this disclosure, a display equipment is provided. The display equipment includes an array substrate, a memory, a processor, and a computer program stored in the memory and executable on the processor. The array substrate includes a pixel array and the common electrode pattern provided in the first aspect of this disclosure, when the computer program is executed by the processor, the steps of the driving method provided in the second aspect of this disclosure are implemented.

In accordance with a fifth aspect of this disclosure, a computer-readable storage medium is provided. In the computer-readable storage medium a computer program is stored, and when the computer program is executed by a processor, the steps of the driving method as provided in the second aspect of this disclosure are implemented.

The common electrode pattern provided in the first aspect of this disclosure includes a first common electrode unit and a second common electrode unit. The first common electrode unit includes a first common electrode line and a plurality of second common electrode lines electrically connected to the first common electrode line. The first common electrode line is configured to be arranged along a first non-display area of the array substrate. The plurality of second common electrode lines are configured to be arranged according to an arrangement of all positive-polarity pixels in a display area of the array substrate, and to provide a common voltage to all the positive-polarity pixels. The second common electrode unit includes a third common electrode line and a plurality of fourth common electrode lines electrically connected to the third common electrode line. The third common electrode line is configured to be arranged along a second non-display area of the array substrate. The plurality of fourth common electrode lines are configured to be arranged according to an arrangement of all negative-polarity pixels in the display area, and to provide a common voltage to all the negative-polarity pixels. By performing common voltage compensations for all positive-polarity pixels and all negative-polarity pixels through two common electrode units, respectively, the difference between the reduction degrees of the pixel potential of the display equipment at different refresh frequencies can be effectively reduced, so that the brightness of the screen displayed by the display equipment at different refresh frequencies tend to be consistent, thereby improving the phenomenon of screen flickering.

It can be understood that, for beneficial effects in the second aspect to the fifth aspect, reference may be made to the relevant description in the first aspect, which are not repeated here.

BRIEF DESCRIPTION OF THE DRAWINGS

In order to illustrate the embodiments of the present application more clearly, the following will briefly introduce the drawings that need to be used for describing the embodiments or exemplary technologies. Obviously, the drawings in the following description are merely some embodiments of the present application, and for those of ordinarily skills in the art, other drawings can also be obtained according to these drawings on the premise of paying no creative labor.

DETAILED DESCRIPTION OF THE EMBODIMENTS

In the following description, for the purpose of illustration rather than limitation, specific details such as a specific system structure and technology are set forth in order to provide a thorough understanding of the embodiments of the present application. However, it will be apparent to those of ordinary skill in the field that the present application may be practiced in other embodiments without these specific details. In other instances, detailed descriptions of well-known systems, devices, circuits, and methods are omitted so as not to obscure the description of the present application with unnecessary detail.

It should be understood that the term "comprise/include", used in this disclosure and the appended claims, indicates the presence of the described feature, integer, step, operation, element and/or component, but does not exclude the presence or addition of one or more other features, integers, steps, operations, elements, components and/or combinations thereof.

It should also be understood that the term "and/or" as used in this disclosure and the appended claims, means that any one of the associated items as listed as well as all possible combinations of one or more of the associated items as listed are included.

As used in this disclosure and the appended claims, the term "if" may be contextually interpreted as "when" or "in case that" or "in response to determining" or "in response to detecting". Similarly, the phrases "if it is determined" or "if [the described condition or event is] detected" may be may be contextually interpreted as "when it is determined" or "in response to a determination of" or "when [the described condition or event is] detected" or "in response to a detection of [the described condition or event]".

In addition, in the description of this disclosure and the appended claims, the terms "first", "second", "third", etc. are only used to distinguish the description, and should not be construed as indicating or implying relative importance.

References to "one embodiment" or "some embodiments" and the like, as described in this disclosure, mean that a particular feature, structure or characteristic described in conjunction with this embodiment is included in one or more embodiments of the present application. Thus, appearances of the phrases "in one embodiment," "in some embodiments," "in other embodiments," "in yet other embodiments," etc., in various places in this disclosure are not necessarily all refer to the same embodiment, but mean "one or more but not all embodiments" unless specifically emphasized otherwise. The terms "comprising", "including", "having" and their variants mean "including but not limited to" unless specifically emphasized otherwise.

Figure 2:
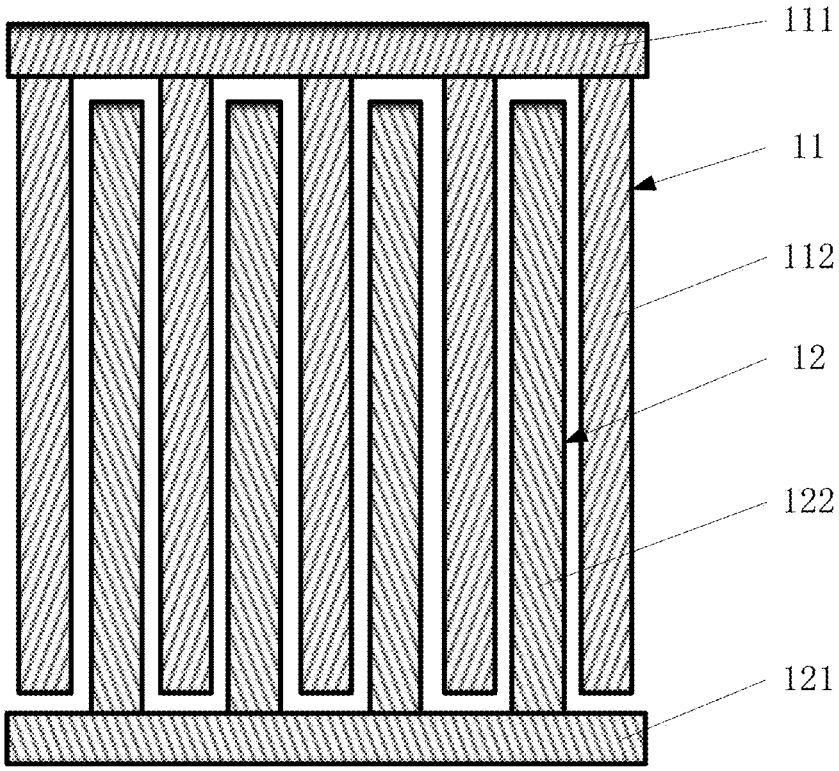
FIG. 2 is a schematic diagram of a common electrode pattern in the 1 column-inversion driving mode in accordance with an embodiment of the present application.
Figure 4:
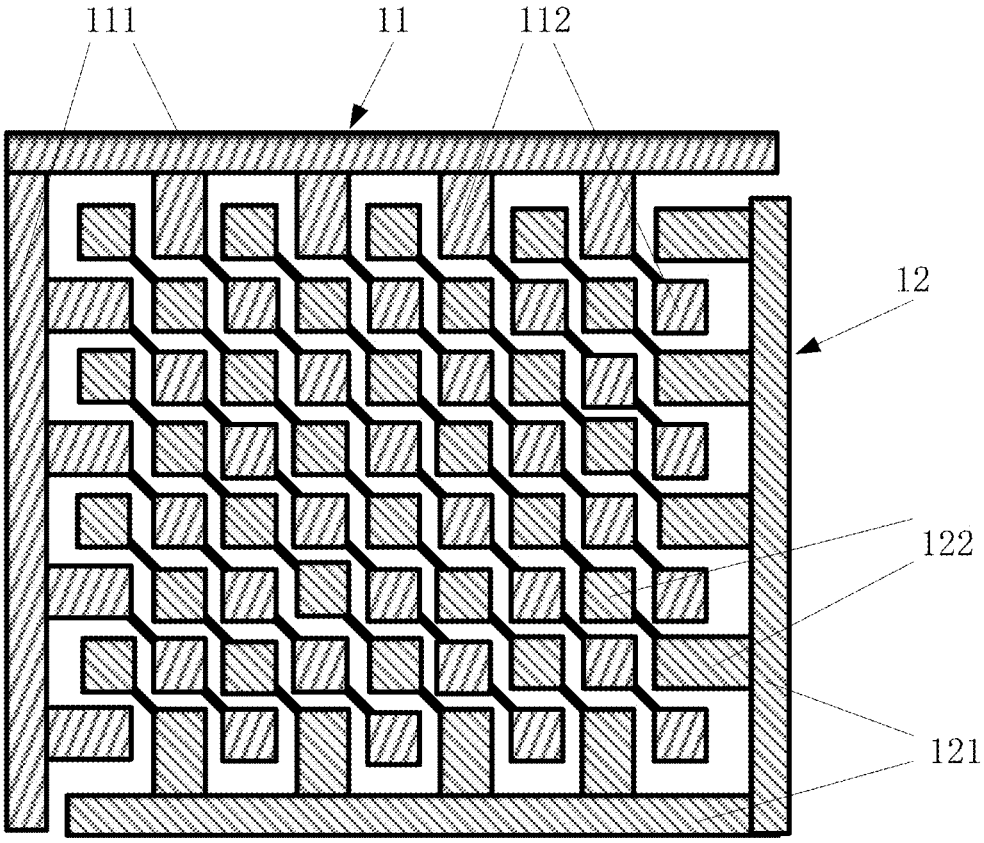
FIG. 4 is a schematic diagram of a common electrode pattern in the dot-inversion driving mode in accordance with an embodiment of the present application.
Figure 6:
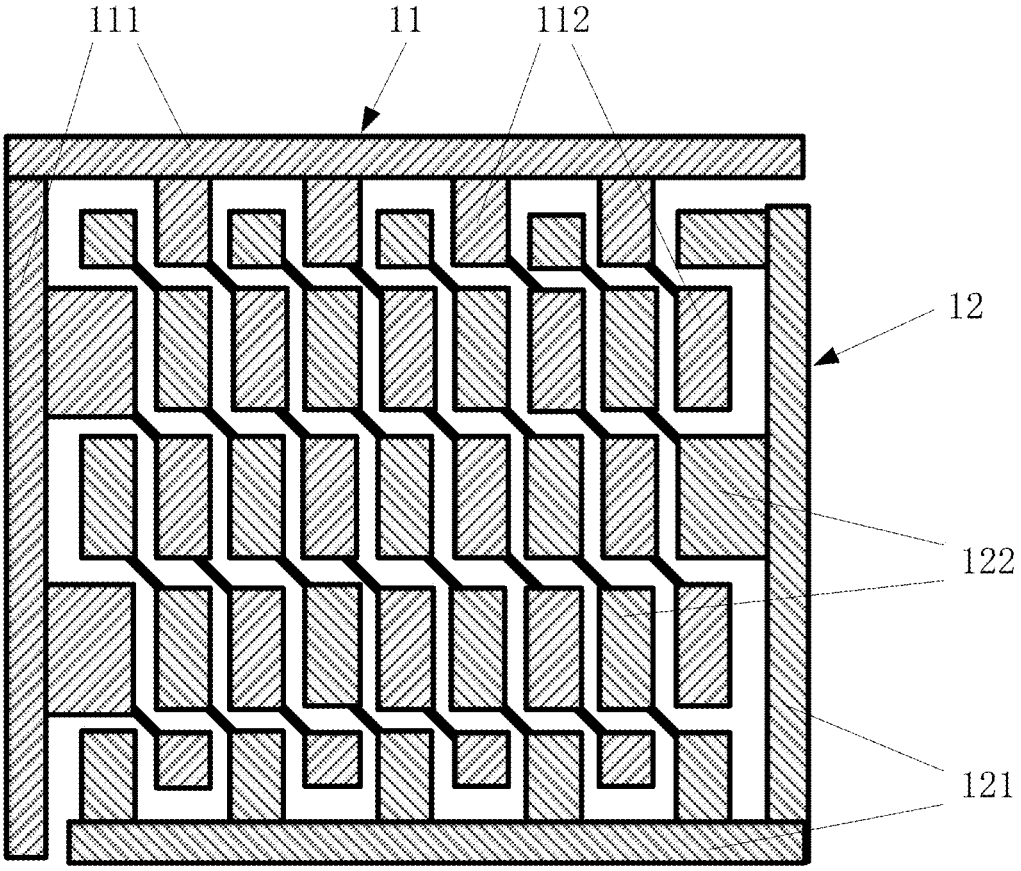
FIG. 6 is a schematic diagram of a common electrode pattern in the 1+2 line-inversion driving mode in accordance with an embodiment of the present application.

As shown in FIG. 2, FIG. 4 or FIG. 6, an embodiment of the present application provides a common electrode pattern, which includes a first common electrode unit 11 and a second common electrode unit 12.

The first common electrode unit 11 includes a first common electrode line 111 and a plurality of second common electrode lines 112.

The first common electrode line 111 is arranged along a first non-display area of an array substrate.

The plurality of second common electrode lines 112 are electrically connected to the first common electrode line 111, and arranged according to an arrangement of all positive-polarity pixels in a display area of the array substrate, to provide a common voltage to all the positive-polarity pixels.

The second common electrode unit 12 includes a third common electrode line 121 and a plurality of fourth common electrode lines 122.

The third common electrode line 121 is arranged along a second non-display area of the array substrate;

The plurality of fourth common electrode lines 122 are electrically connected to the third common electrode line 131, and arranged according to an arrangement of all negative-polarity pixels in the display area, to provide a common voltage to all the negative-polarity pixels.

In an application, the design of the common electrode pattern is related to a polarity inversion driving mode of the pixel array in the display area. In different polarity inversion driving modes, the design of the common electrode pattern is different. The polarity inversion driving mode includes, but is not limited to, an N line-inversion driving mode, a dot-inversion driving mode, and a 1+2 line-inversion driving mode. The N line-inversion driving mode is either an N row-inversion driving mode or an N column-inversion driving mode, and N may be 1 or 2.

In one embodiment, the polarity inversion driving mode of the pixel array is an N line-inversion driving mode.

A plurality of second common electrode lines are arranged according to an arrangement of all lines of positive-polarity pixels, and each second common electrode line is configured to provide the common voltage to a line of positive-polarity pixels. It should be note that the wording "a line of" as used herein is either a row of or a column of.

A plurality of fourth common electrode lines are arranged according to an arrangement of all lines of negative-polarity pixels, and each fourth common electrode line is configured to provide the common voltage to a line of negative-polarity pixels.

Figure 1:
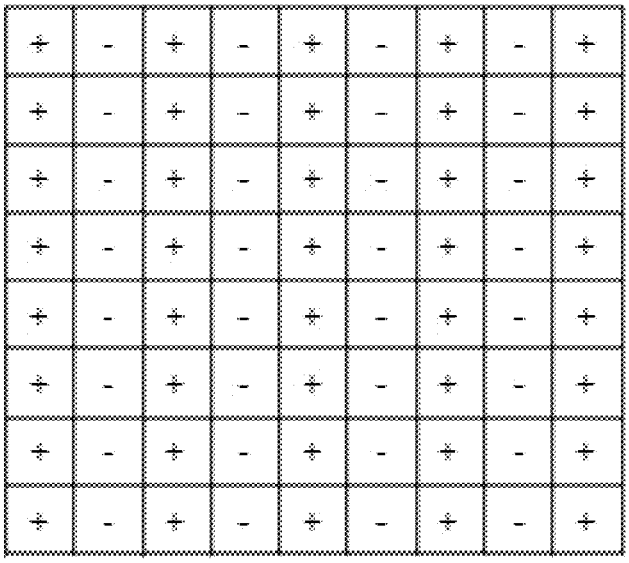
FIG. 1 is a schematic diagram of an arrangement of a pixel array in a 1 column-inversion driving mode in accordance with an embodiment of the present application.

As shown in FIG. 1, a schematic diagram of an arrangement of the pixel array in a 1 column-inversion driving mode is exemplarily shown, where + represents a positive-polarity pixel, and − represents a negative-polarity pixel.

As shown in FIG. 2, a schematic diagram of the common electrode pattern in the 1 column-inversion driving mode is exemplarily shown.

The plurality of second common electrode lines 112 are arranged according to the arrangement of all columns of positive-polarity pixels, and each second common electrode line 112 is configured to provide a common voltage to a column of positive-polarity pixels.

The plurality of fourth common electrode lines 122 are arranged according to the arrangement of all columns of negative-polarity pixels, and each fourth common electrode line 122 is configured to provide a common voltage to a column of negative-polarity pixels.

In one embodiment, the polarity inversion driving mode of the pixel array in the display area is a dot-inversion driving mode. The arrangement of the pixel array is that adjacent pixels of any pixel in a row direction and a column direction have a polarity different from this pixel, and adjacent pixels in a first oblique direction and a second oblique direction have the same polarity as this pixel. An included angle between the first oblique direction and the column direction is in a range from 0° to 90°. An included angle between the second oblique direction and the row direction is in a range from 0° to 90°.

The plurality of second common electrode lines are arranged according to the arrangement of all the positive-polarity pixels, and each second common electrode line is configured to provide the common voltage to a line of positive-polarity pixels in an oblique direction, and the oblique direction is any one of the first oblique direction or the second oblique direction.

The plurality of fourth common electrode lines are arranged according to the arrangement of all the negative-polarity pixels, and each fourth common electrode line is configured to provide a common voltage to a line of negative-polarity pixels in an oblique direction.

Figure 3:
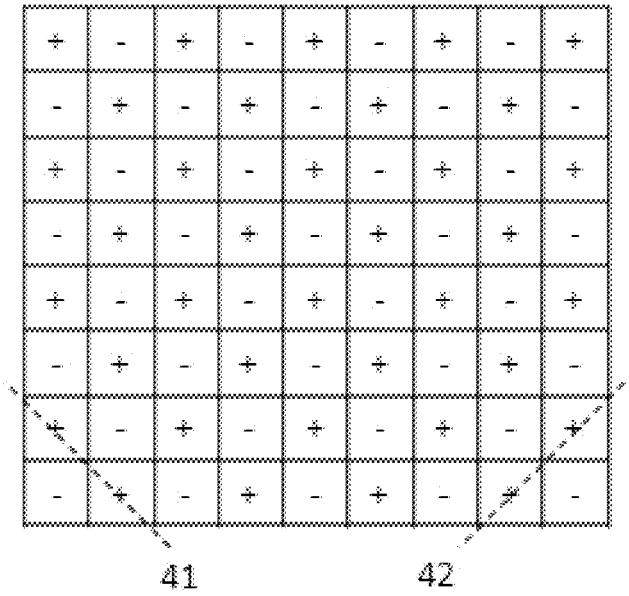
FIG. 3 is a schematic diagram of an arrangement of a pixel array in a dot-inversion driving mode in accordance with an embodiment of the present application.

As shown in FIG. 3, a schematic diagram of the arrangement of the pixel array in a dot-inversion driving mode is exemplarily shown. In FIG. 3, + represents a positive-polarity pixel, − represents a negative-polarity pixel, the direction shown by the dashed line 41 is the first oblique direction, and the direction shown by the dashed line 42 is the second oblique direction.

For any positive-polarity pixel +, the adjacent pixels in the row and column directions are negative-polarity pixels −, and the adjacent pixels in the first oblique direction 41 and the second oblique direction 42 are positive-polarity pixels +.

For any negative-polarity pixel −, the adjacent pixels in the row and column directions of are positive-polarity pixels +, and the adjacent pixels in the first oblique direction 41 and the second oblique direction 42 are negative-polarity pixels −.

As shown in FIG. 4, a schematic diagram of the common electrode pattern in the dot-inversion driving mode is exemplarily shown.

The plurality of second common electrode lines 112 are arranged according to the arrangement of all the positive-polarity pixels, and each second common electrode line 112 is configured to provide a common voltage to a line of positive-polarity pixels in the first oblique direction.

The plurality of fourth common electrode lines 122 are arranged according to the arrangement of all the negative-polarity pixels, and each fourth common electrode line 122 is configured to provide a common voltage to a line of negative-polarity pixels in the first oblique direction.

In one embodiment, the polarity inversion driving mode of the pixel array in the display area is a 1+2 line-inversion driving mode, and the arrangement of the pixel array is that the adjacent pixels of any pixel in the row direction have a polarity different from this pixel, and the adjacent pixels in the column direction include a pixel of a same polarity and a pixel of a different polarity.

The plurality of second common electrode lines are arranged according to the arrangement of all the positive-polarity pixels, and each second common electrode line is configured to provide a common voltage to a line of positive-polarity pixels adjacent in sequence in the column direction and an oblique direction. The oblique direction may be any one of the first oblique direction and the second oblique direction, an included angle between the first oblique direction and the column direction is in a range from 0° to 90°, and an included angle between the second oblique direction and the row direction is also in a range from 0° to 90°.

The plurality of fourth common electrode lines are arranged according to the arrangement of all the negative-polarity pixels, and each fourth common electrode line is configured to provide a common voltage to a line of negative-polarity pixels adjacent sequentially in the column direction and the oblique direction.

Figure 5:
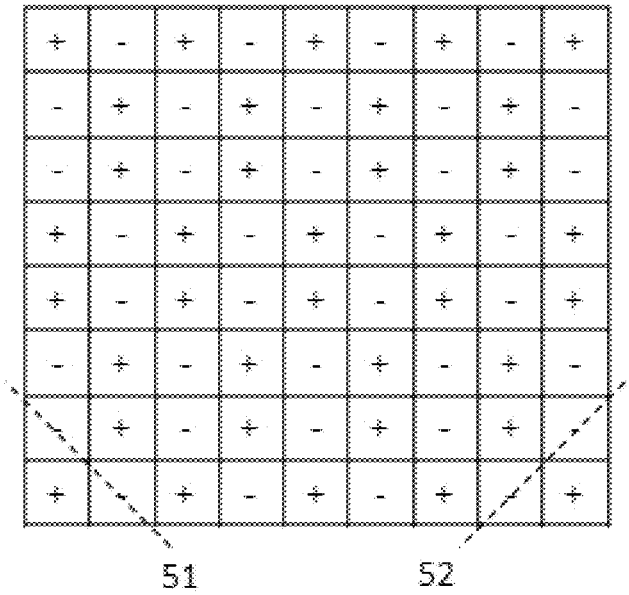
FIG. 5 is a schematic diagram of an arrangement of the pixel array in a 1+2 line-inversion driving mode in accordance with an embodiment of the present application.

As shown in FIG. 5, a schematic diagram of the arrangement of the pixel array in a 1+2 line-inversion driving mode is exemplarily shown. In FIG. 5, + represents a positive-polarity pixel, − represents a negative-polarity pixel, the direction shown by the dashed line 51 is the first oblique direction, and the direction shown by the dashed line 52 is the second oblique direction.

For any positive-polarity pixel +, the adjacent pixels in the row direction are negative-polarity pixels −, and the adjacent pixels in the column direction include a positive-polarity pixel + and a negative-polarity pixel −;

For any negative-polarity pixel −, the adjacent pixels in the row direction are positive-polarity pixels +, and the adjacent pixels in the column-direction include a positive-polarity pixel + and a negative-polarity pixel −.

As shown in FIG. 6, a schematic diagram of the common electrode pattern in the 1+2 line-inversion driving mode is exemplarily shown.

The plurality of second common electrode lines 121 are arranged according to the arrangement of all the positive-polarity pixels, and each second common electrode line 121 is configured to provide a common voltage to a line of positive-polarity pixels adjacent sequentially in the column direction and the first oblique direction.

The plurality of fourth common electrode lines 122 are arranged according to the arrangement of all the negative-polarity pixels, and each fourth common electrode line 122 is configured to provide a common voltage to a line of negative-polarity pixels adjacent sequentially in the column direction and the first oblique direction.

In an application, different common electrode patterns can be used for different polarity inversion driving modes of the pixel array, so that the different common electrode patterns can be applied to a wide range of the display equipment having different polarity inversion driving modes.

An embodiment of the present application provides a method for driving a pixel array based on the common electrode pattern as above mentioned. The method may be executed by a processor of a display equipment when running a corresponding computer program. This method may be applied when a refresh frequency of a current frame displayed by the display equipment is different from a refresh frequency of a reference frame. By adjusting a common voltage of all positive-polarity pixels in a second vertical blank interval through the first common electrode unit, and adjusting a common voltage of all negative-polarity pixels in the second vertical space through the second common electrode unit, a difference between the root mean square (RMS) of differences between the common voltage and the pixel voltage of all pixels in a first vertical blank interval when the reference frame is displayed, and the root mean square of differences between the common voltage and the pixel voltage of all pixels in the second vertical blank interval when the current frame is displayed, is within a preset voltage-difference range. Thus, the difference between the reduction degrees of the pixel potential of the display equipment at different refresh frequencies can be effectively reduced, and the brightness of the screen at different refresh frequencies tend to be consistent, thereby improving the phenomenon of screen flickering.

Figure 7:
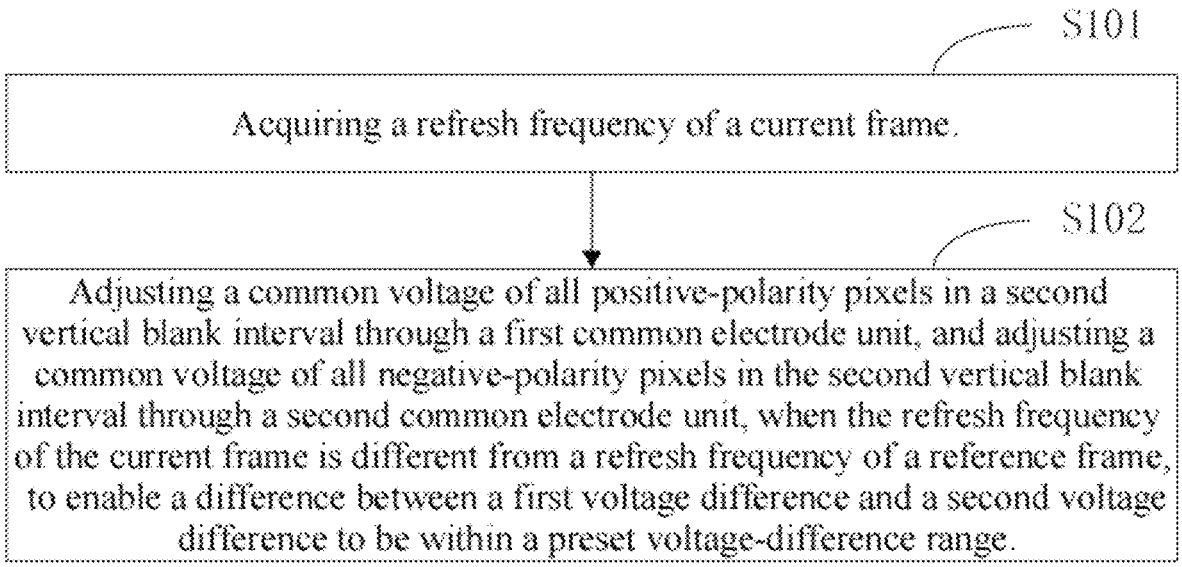
FIG. 7 is a first schematic flowchart of a driving method in accordance with an embodiment of the present application.

As shown in FIG. 7, a driving method in accordance with an embodiment of the present application includes steps S101 and S102.

In the step S101, a refresh frequency of a current frame is acquired.

In the step S102, a common voltage of all positive-polarity pixels in a second vertical blank interval is adjusted through a first common electrode unit, and a common voltage of all negative-polarity pixels in the second vertical blank interval is adjusted through a second common electrode unit, in case that the refresh frequency of the current frame is different from a refresh frequency of a reference frame, to enable a difference between a first voltage difference and a second voltage difference to be within a preset voltage-difference range.

The first voltage difference is a root mean square of differences between the common voltage and the pixel voltage of all pixels in a first vertical blank interval when the reference frame is displayed; the second voltage difference is a root mean square of differences between the common voltage and the pixel voltage of all pixels in the second vertical blank interval when the current frame is displayed.

In an application, when the display equipment displays any frame, the refresh frequency of this frame needs to be obtained and compared with the refresh frequency of the reference frame. In case that the refresh frequencies of the two are different, the common voltage of all pixels in the vertical blank interval needs to be adjusted when this frame is displayed by the display equipment. For the convenience of description, in the embodiments of the present application, the current frame displayed by the display equipment at the current time is used as an example. A vertical blank interval when the reference frame is displayed by the display equipment is defined as the first vertical blank interval. A vertical blank interval when the current frame is displayed by the display equipment is defined as the second vertical blank interval, so as to distinguish the vertical blank intervals when different frames are displayed by the display equipment.

In an application, the reference frame may be a previous frame picture, or may be any preset frame whose refresh frequency and vertical blank interval are known. By setting the reference frame as the previous frame picture, the brightness of multiple frames continuously displayed by the display equipment can be made to be consistent with the brightness of the first frame. In this way, when the multiple frames corresponding to one image data packet or video data packet (also called video data stream) are displayed by the display equipment, the brightness of the multiple frames corresponding to the same image data packet or video data packet tend to be consistent. In case that the multiple frames corresponding to different image data packets or video data packets are displayed, if the first frames corresponding to the different image data packets or video data packets are of the same brightness, then the brightness of the multiple frames corresponding to the different image data packets or video data packets is the same. If the first frames corresponding to the different image data packets or video data packets are of different brightness, then the brightness of the multiple frames corresponding to different image data packets or video data packets is different. By setting the reference frame as the preset frame, the brightness of the multiple frames continuously displayed by the display equipment can be made consistent with the brightness of the preset picture. In this way, when the multiple frames corresponding to different image data packets or video data packets (also called video data streams) are displayed by the display equipment, the brightness of the multiple frames corresponding to all image data packets or video data packets tend to be consistent.

In an application, the refresh frequency of the current frame may be smaller than the refresh frequency of the reference frame, and then the second vertical blank interval is greater than the first vertical blank interval. The refresh frequency of the current frame may also be greater than that of the reference frame, and then the second vertical blank interval is smaller than the first vertical blank interval.

Figure 8:
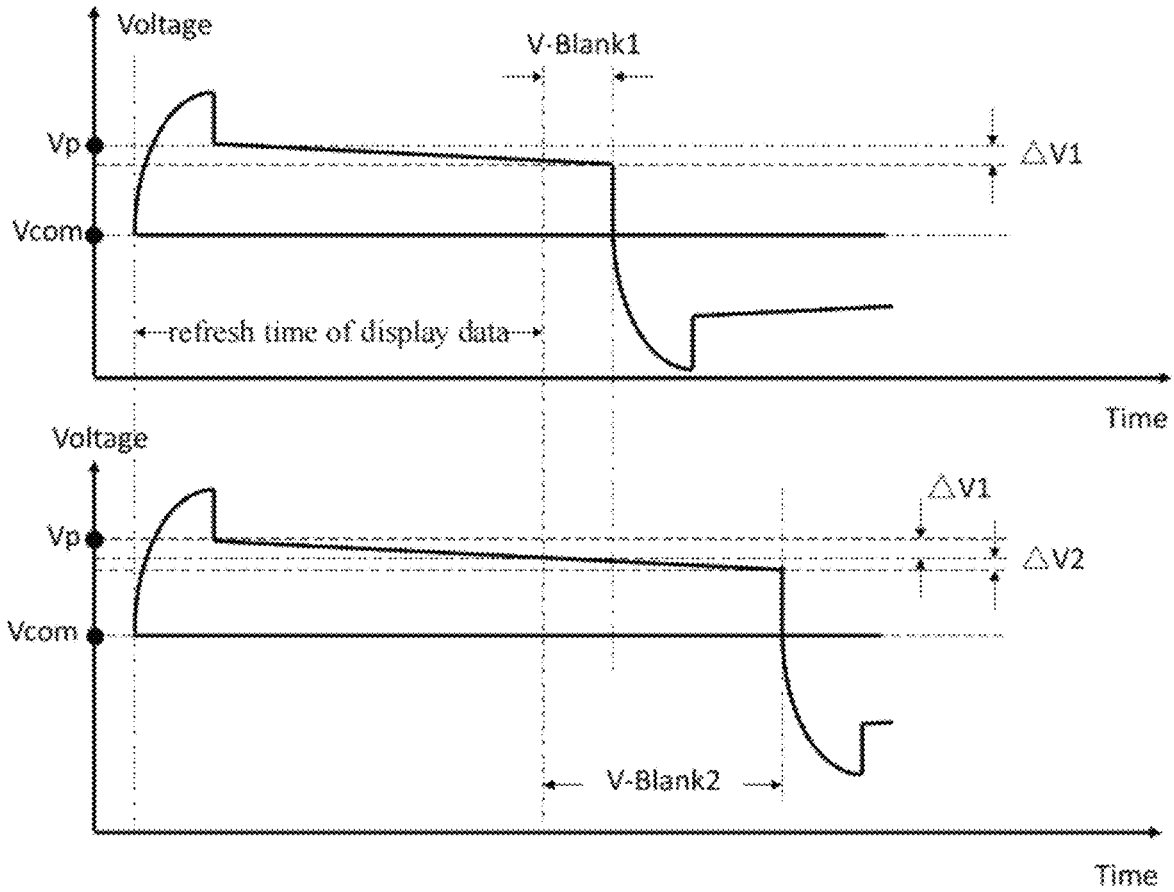
FIG. 8 is a schematic diagram showing time-dependent changes of a pixel voltage and a common voltage when a reference frame or a current frame is displayed by a display equipment in accordance with an embodiment of the present application.

As shown in FIG. 8, it exemplarily shows schematic diagrams of the pixel voltage Vp and the common voltage Vcom changing with time when the reference frame and the current frame are displayed by the display equipment respectively, in case that the refresh frequency of the current frame is smaller than the refresh frequency of the reference frame, and the second vertical blank interval is greater than the first vertical blank interval. In FIG. 8, V-Blank1 represents the first vertical blank interval, ΔV1 represents a difference between an initial pixel voltage and a pixel voltage at the end of the first vertical blank interval, V-Blank2 represents the second vertical blank interval, and ΔV2 represents a difference between the pixel voltage at the end of the first vertical blank interval and a pixel voltage at the end of the second vertical blank interval. The initial pixel voltage is the pixel voltage that the data driving circuit (e.g., a source driver) outputs to the pixel to charge the pixel when the reference frame is displayed by the display equipment display.

In an application, a calculation of the root mean square includes the following steps: getting the squares of all the values obtained in a duration period, calculating the average of the obtained squares, and taking the square root of the average, to get the root mean square.

Similarly, the calculation of the first voltage difference, when the reference frame is displayed to the display equipment, includes the following steps: getting the squares of m (m is an integer greater than 1) difference values A1, A2, . . . , Am between the common voltage and the pixel voltage obtained by all the pixels at m time points within the first vertical blank interval, to obtain a sum $\Sigma 1=A1^2+A2^2+\ldots+Am^2$, then calculating the average of the obtained sum Σ1, i.e., the average $Avg1=\Sigma 1/m=(A1^2+A2^2+\ldots+Am^2)/m$, and then taking the square root of the average to get the root mean square, and the root mean square (that is, the first voltage difference) $D1=\sqrt{Avg1}$;

The calculation of the second voltage difference, when the current frame is displayed to the display equipment, includes the following steps: getting the squares of n difference values B1, B2, . . . , Bn between the common voltage and the pixel voltage obtained by all the pixels at n (n is an integer greater than 1) time points within the second vertical blank interval, to obtain a sum $\Sigma 2=B1^2+B2^2+\ldots+Bn^2$, then calculating the average of the obtained sum Σ2, i.e., the average $Avg2=\Sigma 2/n=(B1^2+B2^2+\ldots+Bn^2)/n$, and then taking the square root of the average to get the root mean square, and the root mean square (that is, the second voltage difference) $D2=\sqrt{Avg2}$.

In an application, the time intervals between any two adjacent time points among the m time points are equal, and the larger the value of m, the more accurate the calculation result of the first voltage difference will be. Similarly, the time intervals between any two adjacent time points among the n time points are equal, and the larger the value of n, the more accurate the calculation result of the second voltage difference will be.

In an application, the range of the preset voltage difference can be set according to actual needs. The smaller the range of the preset voltage difference, the more consistent the brightness of the screen displayed by the adjusted display equipment at different refresh frequencies will be, and the better the effect of improving the phenomenon of screen flickering will be. The preset voltage-difference range may also be equivalently replaced with a single ideal value of 0, and at this time, the screen brightness displayed by the adjusted display equipment at different refresh frequencies is exactly the same, and the phenomenon of screen flickering can be completely eliminated.

In an application, the range for adjusting the common voltage is between an initial common voltage and a target common voltage, and a difference between the initial common voltage and the target common voltage is equal to a third voltage difference. The third voltage difference is a difference between the initial pixel voltage and a pixel voltage at an end time-point of the second vertical blank interval, that is, the third voltage difference is a change amount of the pixel voltage between a start time-point and an end time-point where the current frame is displayed by the display equipment.

In an application, based on the difference in the adjustment manner of the common voltage, the step S102 of adjusting the common voltage of all positive-polarity pixels in the second vertical blank interval through the first common electrode unit may include the following modes.

Mode 1: the common voltage of all the positive-polarity pixels in the second vertical blank interval is adjusted in a vertical change manner through the first common electrode unit, so that the common voltage changes vertically in the second vertical blank interval.

Mode 2: the common voltage of all the positive-polarity pixels in the second vertical blank interval is adjusted in a linear change manner through the first common electrode unit, so that the common voltage changes linearly in the second vertical blank interval.

Mode 3: the common voltage of all the positive-polarity pixels in the second vertical blank interval is adjusted in an oscillation change manner through the first common electrode unit, so that the common voltage oscillates and changes in the second vertical blank interval.

Mode 4: the common voltage of all the positive-polarity pixels in the second vertical blank interval is adjusted in a step-by-step manner through the first common electrode unit, so that the common voltage changes stepwise in the second vertical blank interval.

The step S102 of adjusting the common voltage of all negative-polarity pixels in the second vertical blank interval through the second common electrode unit may include the following modes.

Mode 1: the common voltage of all the negative-polarity pixels in the second vertical blank interval is adjusted in a vertical change manner through the second common electrode unit, so that the common voltage changes vertically in the second vertical blank interval.

Mode 2: the common voltage of all the negative-polarity pixels in the second vertical blank interval is adjusted in a linear change manner through the second common electrode unit, so that the common voltage changes linearly in the second vertical blank interval.

Mode 3: the common voltage of all the negative-polarity pixels in the second vertical blank interval is adjusted in an oscillation change manner through the second common electrode unit, so that the common voltage oscillates and changes in the second vertical blank interval.

Mode 4: the common voltage of all the negative-polarity pixels in the second vertical blank interval is adjusted in a step-by-step change manner through the second common electrode unit, so that the common voltage changes stepwise in the second vertical blank interval.

In practical applications, any one of the above four modes for adjusting the common voltage of all the positive-polarity pixels or all the negative-polarity pixels can be selected according to actual needs. The selected modes for adjusting the common voltage of all the positive-polarity pixels and all the negative-polarity pixels may be the same or different, and other voltage adjustment modes may also be adopted, as long as the common voltage changes uniformly between the initial common voltage and the target common voltage. By adopting the mode 1, the common voltage applied to all the positive-polarity pixels or negative-polarity pixels of the display equipment remains unchanged in the second vertical blank interval, so that the common-voltage generation circuit only needs to generate a single-sized common voltage in the second vertical blank interval, and thus a voltage adjustment logic of the common-voltage generation circuit can be simplified, thereby simplifying a circuit structure of the common-voltage generation circuit, saving costs, and effectively saving computing resources and execution time of the processor. By adopting the mode 1, mode 2 or mode 3, the common voltage applied to all the positive-polarity pixels or negative-polarity pixels of the display equipment is uniformly changed in the second vertical blank interval, so that the common-voltage generation circuit only needs to generate a common voltage uniformly changing according to a certain change rule in the second vertical blank interval, to make the voltage adjustment logic of the common-voltage generation circuit regular, thereby facilitating a configuration of the circuit structure of the common-voltage generation circuit, and also effectively saving the computing resources and execution time of the processor.

In an application, when the current frame is displayed by the display equipment, the adjustment manner of the common voltage of all pixels is also related to the polarity of the pixels.

Figure 9:
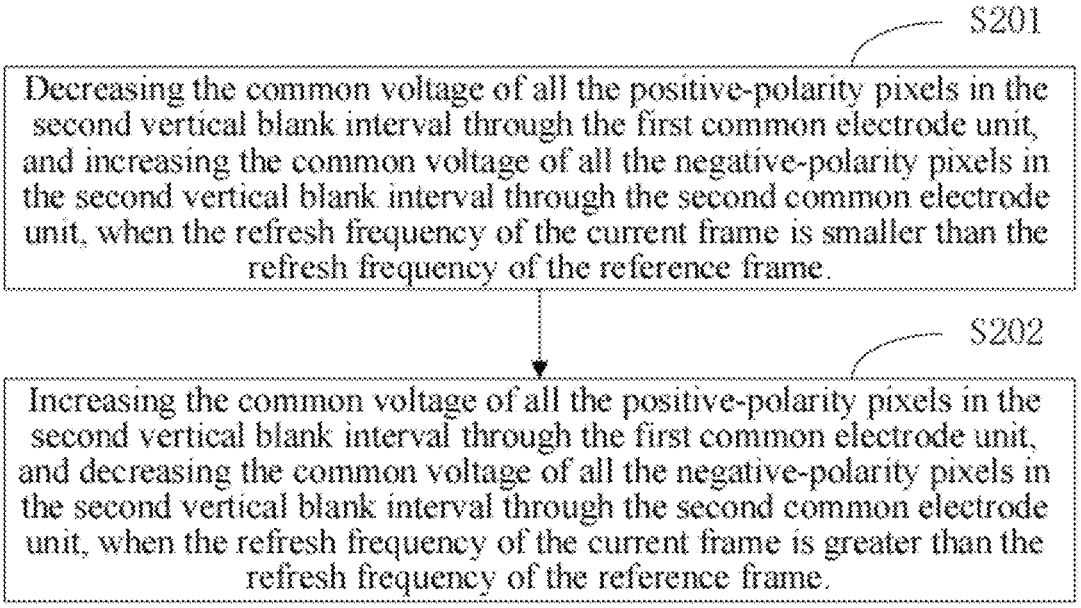
FIG. 9 is a second schematic flowchart of the driving method in accordance with an embodiment of the present application.

As shown in FIG. 9, in one embodiment, based on different pixel polarities, the step S102 may include steps S201 and S202.

In the step S201, the common voltage of all the positive-polarity pixels in the second vertical blank interval is decreased through the first common electrode unit, and the common voltage of all the negative-polarity pixels in the second vertical blank interval is increased through the second common electrode unit, in case that the refresh frequency of the current frame is smaller than the refresh frequency of the reference frame.

In the step S202, the common voltage of all the positive-polarity pixels in the second vertical blank interval is increased through the first common electrode unit, and the common voltage of all the negative-polarity pixels in the second vertical blank interval is decreased through the second common electrode unit, in case that the refresh frequency of the current frame is greater than the refresh frequency of the reference frame.

In an application, based on the common electrode patterns in various polarity inversion driving modes provided in the above embodiments, the driving method provided in this disclosure can be applied to the display equipment having these common electrode patterns, and has a wide range of applications.

Figure 10:
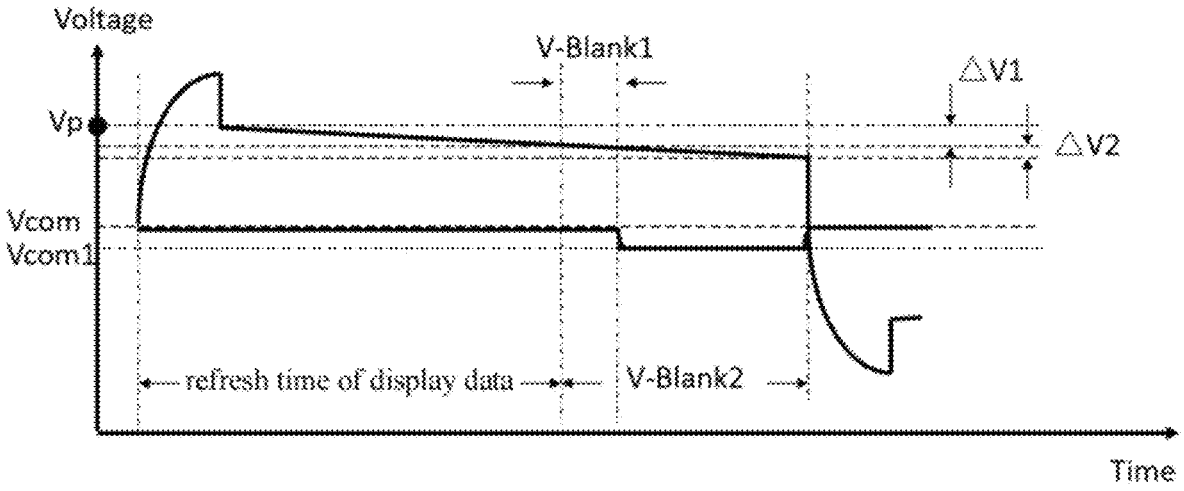
FIG. 10 is a schematic diagram showing the time-dependent changes of the pixel voltage and the common voltage of positive-polarity pixels in a vertical change manner when the current frame is displayed by the display equipment in accordance with an embodiment of the present application.

As shown in FIG. 10, it exemplarily shows a schematic diagram of the pixel voltage Vp and the common voltage Vcom of the positive-polarity pixel changing with time in the vertical change manner when the current frame is displayed by the display equipment, in case that the refresh frequency of the current frame is smaller than the refresh frequency of the reference frame, and the second vertical blank interval is greater than the first vertical blank interval. In FIG. 10, Vcom1 represents the target common voltage.

Figure 11:
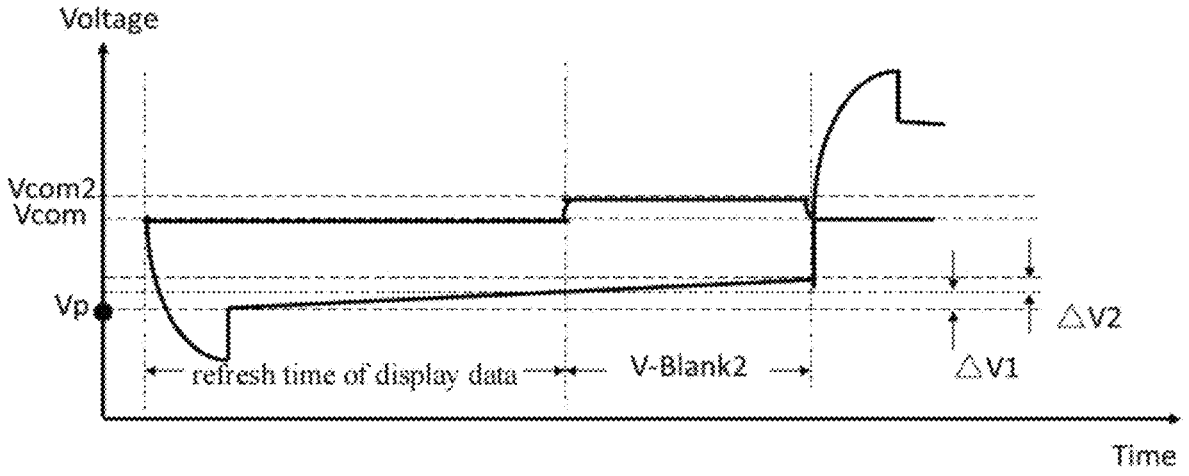
FIG. 11 is a schematic diagram showing the time-dependent changes of the pixel voltage and the common voltage of negative-polarity pixels in the vertical change manner when the current frame is displayed by the display equipment in accordance with an embodiment of the present application.

As shown in FIG. 11, it exemplarily shows a schematic diagram of the pixel voltage Vp and the common voltage Vcom of the negative-polarity pixel changing with time in the vertical change manner when the current frame is displayed by the display equipment, in case that the refresh frequency of the current frame is smaller than the refresh frequency of the reference frame, and the second vertical blank interval is greater than the first vertical blank interval. In FIG. 11, Vcom2 represents the target common voltage.

Figure 12:
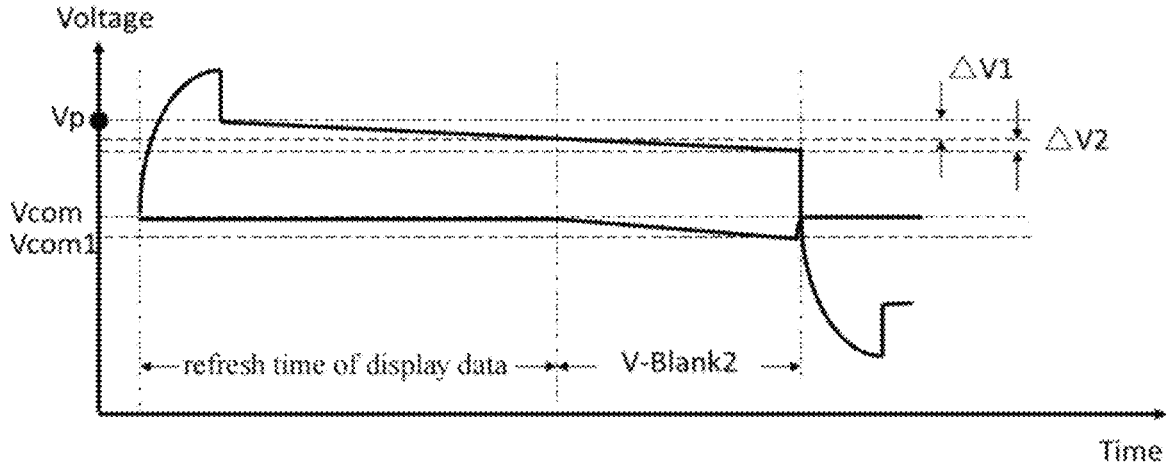
FIG. 12 is a schematic diagram showing the time-dependent changes of the pixel voltage and the common voltage of the positive-polarity pixels in a linear change manner when the current frame is displayed by the display equipment in accordance with an embodiment of the present application.

As shown in FIG. 12, it exemplarily shows a schematic diagram of the pixel voltage Vp and the common voltage Vcom of the positive-polarity pixel changing with time in the linear change manner when the current frame is displayed by the display equipment, in case that the refresh frequency of the current frame is smaller than the refresh frequency of the reference frame, and the second vertical blank interval is greater than the first vertical blank interval. In FIG. 12, Vcom1 represents the target common voltage.

Figure 13:
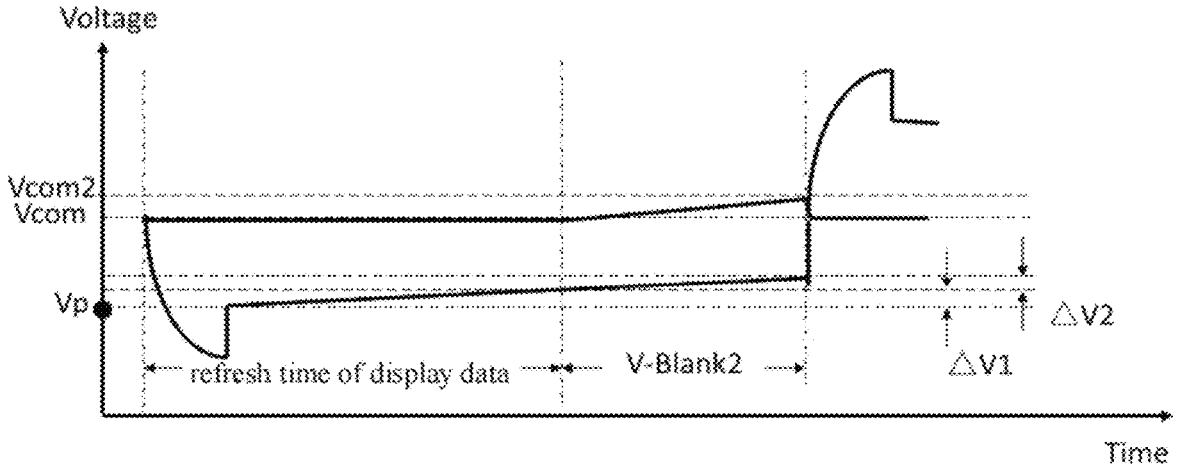
FIG. 13 is a schematic diagram showing the time-dependent changes of the pixel voltage and the common voltage of the negative-polarity pixels in the linear change manner when the current frame is displayed by the display equipment in accordance with an embodiment of the present application.

As shown in FIG. 13, it exemplarily shows a schematic diagram of the pixel voltage Vp and the common voltage Vcom of the negative-polarity pixel changing with time in the linear change manner when the current frame is displayed by the display equipment, in case that the refresh frequency of the current frame is smaller than the refresh frequency of the reference frame, and the second vertical blank interval is greater than the first vertical blank interval. In FIG. 13, Vcom2 represents the target common voltage.

Figure 14:
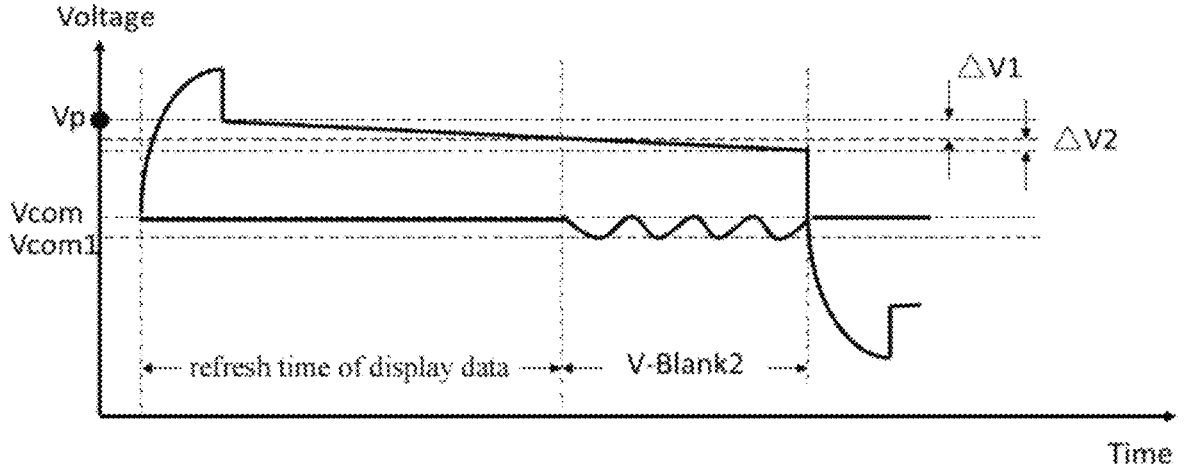
FIG. 14 is a schematic diagram showing the time-dependent changes of the pixel voltage and the common voltage of the positive-polarity pixels in an oscillation change manner when the current frame is displayed by the display equipment in accordance with an embodiment of the present application.

As shown in FIG. 14, it exemplarily shows a schematic diagram of the pixel voltage Vp and the common voltage Vcom of the positive-polarity pixel changing with time in the oscillation change manner when the current frame is displayed by the display equipment, in case that the refresh frequency of the current frame is smaller than the refresh frequency of the reference frame, and the second vertical blank interval is greater than the first vertical blank interval. In FIG. 14, Vcom1 represents the target common voltage.

Figure 15:
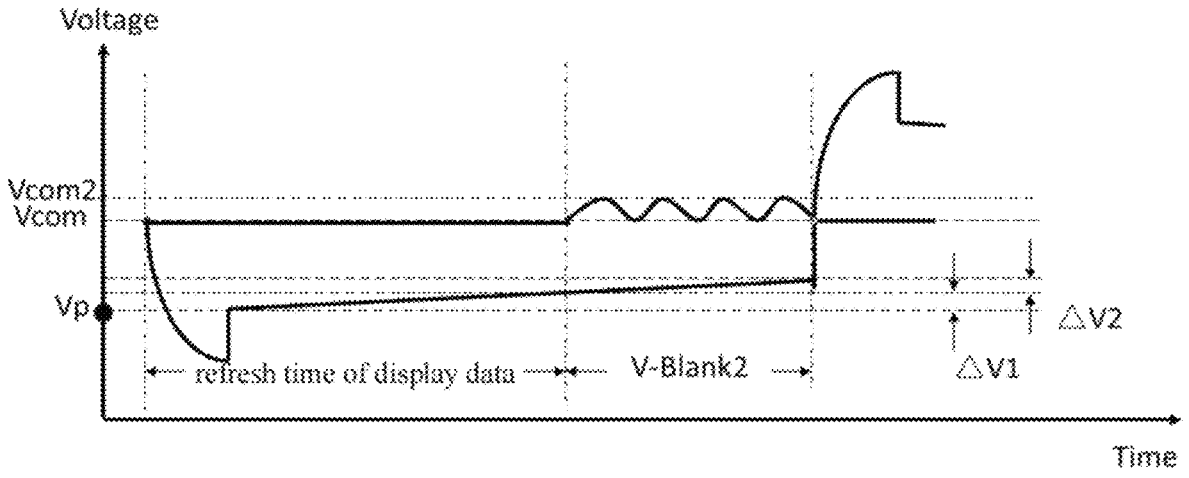
FIG. 15 is a schematic diagram showing the time-dependent changes of the pixel voltage and the common voltage of the negative-polarity pixels in the oscillation change manner when the current frame is displayed by the display equipment in accordance with an embodiment of the present application.

As shown in FIG. 15, it exemplarily shows a schematic diagram of the pixel voltage Vp and the common voltage Vcom of the negative-polarity pixel changing with time in the oscillation change manner when the current frame is displayed by the display equipment, in case that the refresh frequency of the current frame is smaller than the refresh frequency of the reference frame, and the second vertical blank interval is greater than the first vertical blank interval. In FIG. 15, Vcom2 represents the target common voltage.

Figure 16:
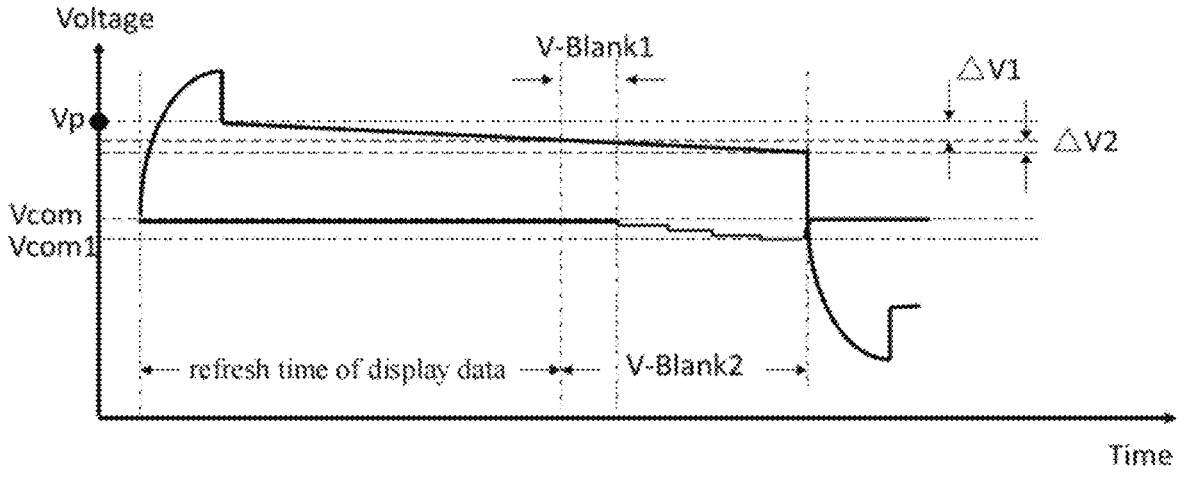
FIG. 16 is a schematic diagram showing the time-dependent changes of the pixel voltage and the common voltage of the positive-polarity pixels in a step-by-step change manner when the current frame is displayed by the display equipment in accordance with an embodiment of the present application.

As shown in FIG. 16, it exemplarily shows a schematic diagram of the pixel voltage Vp and the common voltage Vcom of the positive-polarity pixel changing with time in the step-by step change manner when the current frame is displayed by the display equipment, in case that the refresh frequency of the current frame is smaller than the refresh frequency of the reference frame, and the second vertical blank interval is greater than the first vertical blank interval. In FIG. 16, Vcom1 represents the target common voltage.

Figure 17:
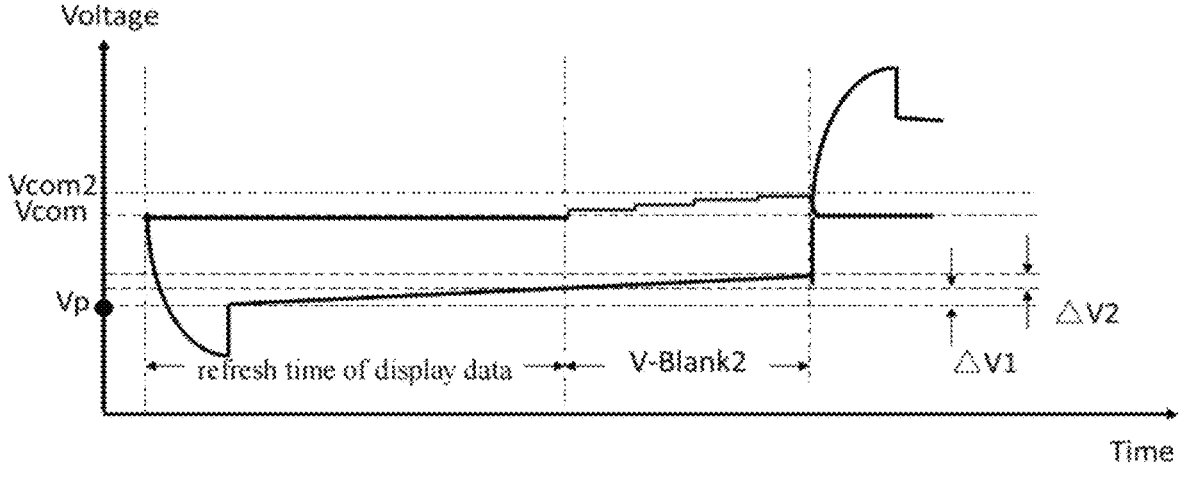
FIG. 17 is a schematic diagram showing the time-dependent changes of the pixel voltage and the common voltage of the negative-polarity pixels in the step-by-step change manner when the current frame is displayed by the display equipment in accordance with an embodiment of the present application.

As shown in FIG. 17, it exemplarily shows a schematic diagram of the pixel voltage Vp and the common voltage Vcom of the negative-polarity pixel changing with time in the step-by step change manner when the current frame is displayed by the display equipment, in case that the refresh frequency of the current frame is smaller than the refresh frequency of the reference frame, and the second vertical blank interval is greater than the first vertical blank interval. In FIG. 17, Vcom2 represents the target common voltage.

Figure 18:
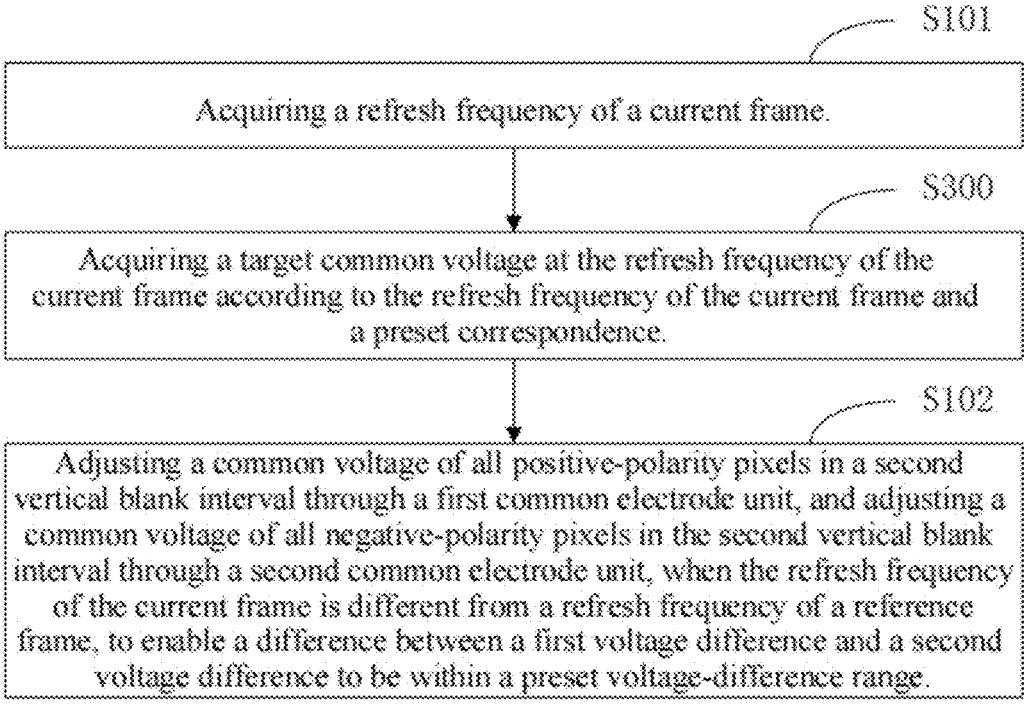
FIG. 18 is a third schematic flowchart of the driving method in accordance with an embodiment of the present application.

As shown in FIG. 18, in this embodiment, after the step S101 and before the step S102 as described in the above embodiments, the following step S300 may be included.

In the step S300, a target common voltage at the refresh frequency of the current frame is acquired according to the refresh frequency of the current frame and a preset correspondence.

In this embodiment, the preset correspondence is a corresponding relationship between the preset refresh frequency and the target common voltage at the preset refresh frequency.

In an application, the vertical blank intervals of the display equipment at different refresh frequencies are different, resulting in different degrees of potential reduction of the pixels, such that the target common voltage of the display equipment are different at different refresh frequencies. Thus, the target common voltage of the display equipment at multiple different preset refresh frequencies may be detected in advance, and then the preset correspondence between each preset refresh frequency and the target common voltage at the preset refresh frequency is established, thereby the target common voltage at the refresh frequency of the current frame can be quickly determined according to the refresh frequency of the current frame and the preset correspondence during a driving process of the display equipment.

In an application, the number of preset correspondences detected and established in advance should be large enough to ensure that during the driving process of the display equipment, a preset refresh frequency that is the same as the refresh frequency of the current frame can be found among all the preset correspondences, and then find the target common voltage corresponding to the preset refresh frequency.

In an application, if the preset refresh frequency that is the same as the refresh frequency of the current frame cannot be found among all the preset correspondences, then a preset refresh frequency that is close to the refresh frequency of the current frame may be searched, and the target common voltage at the closer preset refresh frequency may be served as the target common voltage at the refresh frequency of the current frame. The preset refresh frequency that is close to the refresh frequency of the current frame may be a preset refresh frequency whose difference from the refresh frequency of the current frame is within a preset frequency range. The preset frequency range can be set according to actual needs, and the setting standard is that the brightness of the screen displayed by the display equipment does not change significantly, and the screen does not flicker obviously, when the target common voltage at the preset refresh frequency serves as the target common voltage at refresh frequency of the current frame, where the difference between the preset refresh frequency and the refresh frequency of the current frame is within the preset frequency range.

In an application, the preset correspondence may be a mapping relationship, may exist in the form of a correspondence table such as a look-up table (LUT), or may exist in the form of searching through other input data and outputting the corresponding search result. By establishing a preset correspondence in advance, the corresponding target common voltage can be quickly found according to the refresh frequency of the current frame, thereby effectively saving the computing resources and execution time of the processor.

Figure 19:
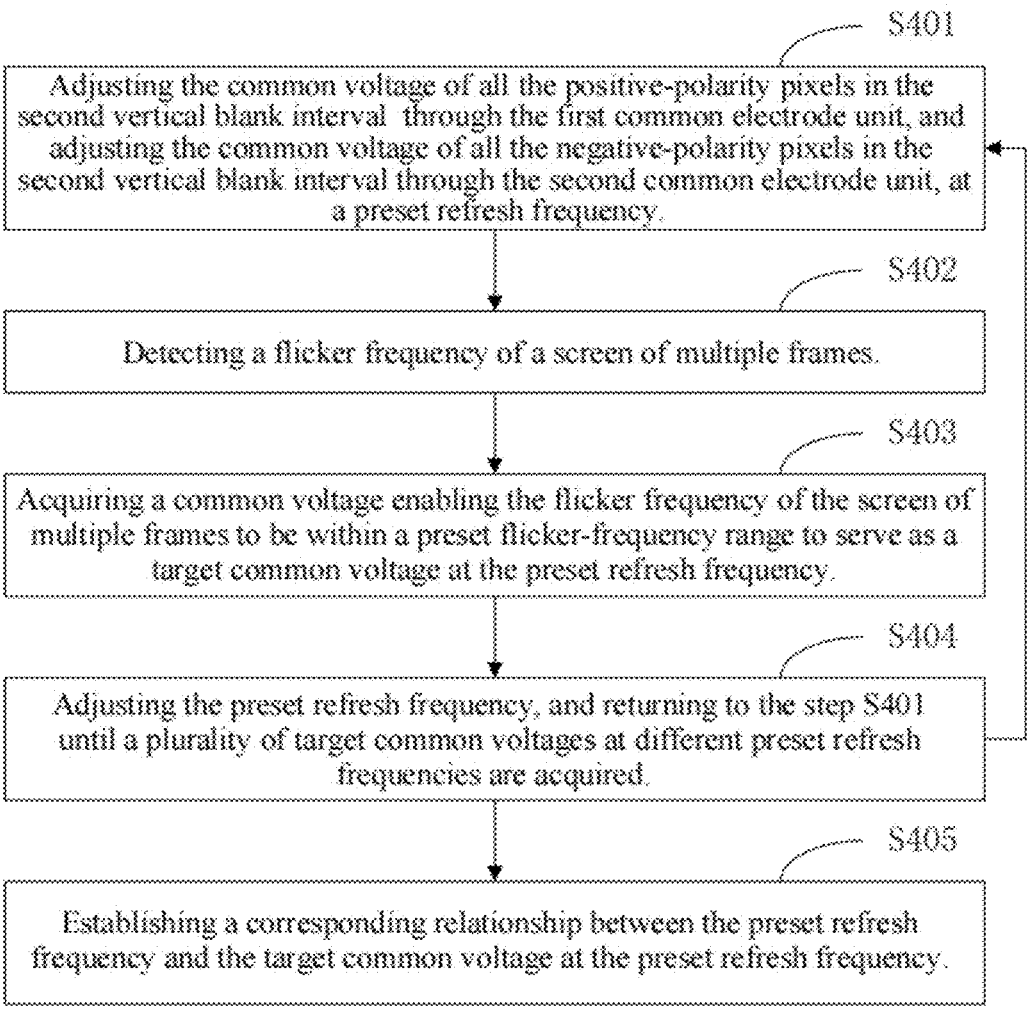
FIG. 19 is a fourth schematic flowchart of the driving method in accordance with an embodiment of the present application.

As shown in FIG. 19, an implementation of establishing a preset correspondence is exemplarily shown, and the implementation may include steps S401 to S405 before the step S101.

In the step S401, the common voltage of all the positive-polarity pixels in the second vertical blank interval is adjusted through the first common electrode unit, and the common voltage of all the negative-polarity pixels in the second vertical blank interval is adjusted through the second common electrode unit, at a preset refresh frequency.

In the step S402, a flicker frequency of a screen of multiple frames is detected.

In the step S403, a common voltage enabling the flicker frequency of the screen of multiple frames to be within a preset flicker-frequency range is acquired as a target common voltage at the preset refresh frequency.

In the step S404, the preset refresh frequency is adjusted, and the step S401 is restarted until a plurality of target common voltages at different preset refresh frequencies are acquired.

In the step S405, a corresponding relationship between the preset refresh frequency and the target common voltage at the preset refresh frequency is established.

In an application, first of all, the common voltage of all pixels in the second vertical blank interval is continuously adjusted, under a preset refresh frequency, when the screen of multiple frames is displayed by the display equipment, the flicker frequency (i.e., changes in brightness) of the screen of multiple frames is detected, the common voltage enabling the flicker frequency of the multiple frames to be within the preset flicker-frequency range is acquired as the target common voltage at the preset refresh frequency. Then, the preset refresh frequency is adjusted, and the steps S401 to S403 are repeated until enough target common voltages at different preset refresh frequencies are acquired. Finally, the corresponding relationship between the preset refresh frequency and the target common voltage at the preset refresh frequency is established.

In an application, the preset flicker-frequency range can be set according to actual needs. The setting standard is that the screen of multiple frames displayed by the display equipment has no obvious flicker, when the common voltage of all pixels of the display equipment in the second vertical blank interval is adjusted to the target common voltage at the preset refresh frequency.

It should be understood that the size of the sequence numbers of the steps in the above-mentioned embodiments does not mean the order of execution, and the execution order of each process should be determined by its function and internal logic, and should not constitute any limitations to implementation processes of the embodiments of the present application.

In accordance with an exemplary embodiment of the present application, a driving device of a pixel array is also provided. The driving device is implemented based on a processor of a display equipment and is used to execute the steps in the above driving method embodiments. The driving device may be a virtual appliance in the display equipment, executed by the processor of the display equipment, or may be the display equipment itself.

Figure 20:
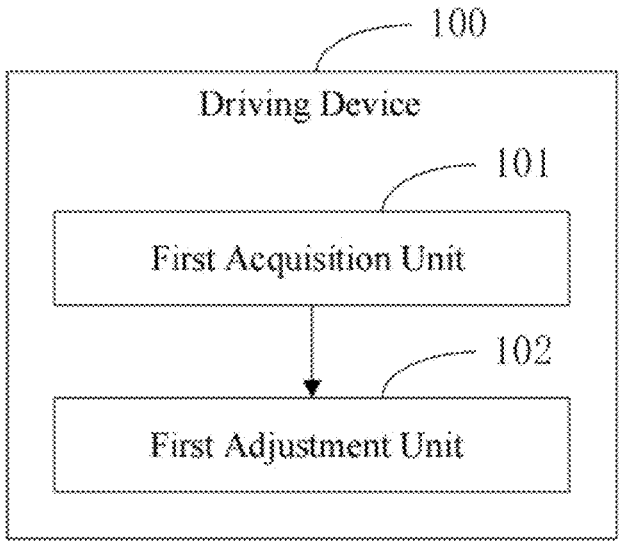
FIG. 20 is a schematic structural diagram of a driving device in accordance with an embodiment of the present application.

As shown in FIG. 20, the driving device 100 in accordance with an embodiment of the present application includes a first acquisition unit 101 and a first adjustment unit 102.

The first acquisition unit 101 is configured to acquire a refresh frequency of a current frame.

The first adjustment unit 102 is configured to adjust a common voltage of all positive-polarity pixels in a second vertical blank interval through a first common electrode unit, and adjust a common voltage of all negative-polarity pixels in the second vertical blank interval through the second common electrode unit, in case that the refresh frequency of the current frame is different from a refresh frequency of a reference frame, to enable a difference between a first voltage difference and a second voltage difference to be within a preset voltage-difference range. The first voltage difference is a root mean square of differences between a common voltage and a pixel voltage of all pixels in a first vertical blank interval when a reference frame is displayed. The second voltage difference is a root mean square of differences between the common voltage and the pixel voltage of all the pixels in the second vertical blank interval when the current frame is displayed.

In one embodiment, the driving device may also include a second acquisition unit which is configured to acquire a target common voltage at the refresh frequency of the current frame according to the refresh frequency of the current frame and a preset correspondence.

In one embodiment, the driving device may also include a second adjustment unit, a detection unit, a third acquisition unit, a third adjustment unit, and an establishment unit.

The second adjustment unit is configured to adjust the common voltage of all the positive-polarity pixels in the second vertical blank interval through the first common electrode unit, and adjust the common voltage of all the negative-polarity pixels in the second vertical blank interval through the second common electrode unit, at the preset refresh frequency.

The detection unit is configured to detect a flicker frequency of a screen of multiple frames.

The third acquisition unit is configured to acquire a common voltage enabling the flicker frequency of the screen of multiple frames to be within a preset flicker-frequency range, to serve as the target common voltage at the preset refresh frequency.

The third adjustment unit is configured to adjust the preset refresh frequency, and return to the second adjustment unit until a plurality of the target common voltages at different preset refresh frequencies are acquired.

The establishment unit is configured to establish a corresponding relationship between the preset refresh frequency and the target common voltage at the preset refresh frequency.

In an application, each unit in the driving device may be a software program unit, or may be implemented by different logic circuits integrated in the processor, or may be implemented by multiple distributed processors. The first adjustment unit and the second adjustment unit may be implemented by the same or different common-voltage generation circuits, for example, the first adjusting unit is implemented by a first common-voltage generation circuit, and the second adjusting unit is implemented by a second common-voltage generation circuit.

Figure 21:
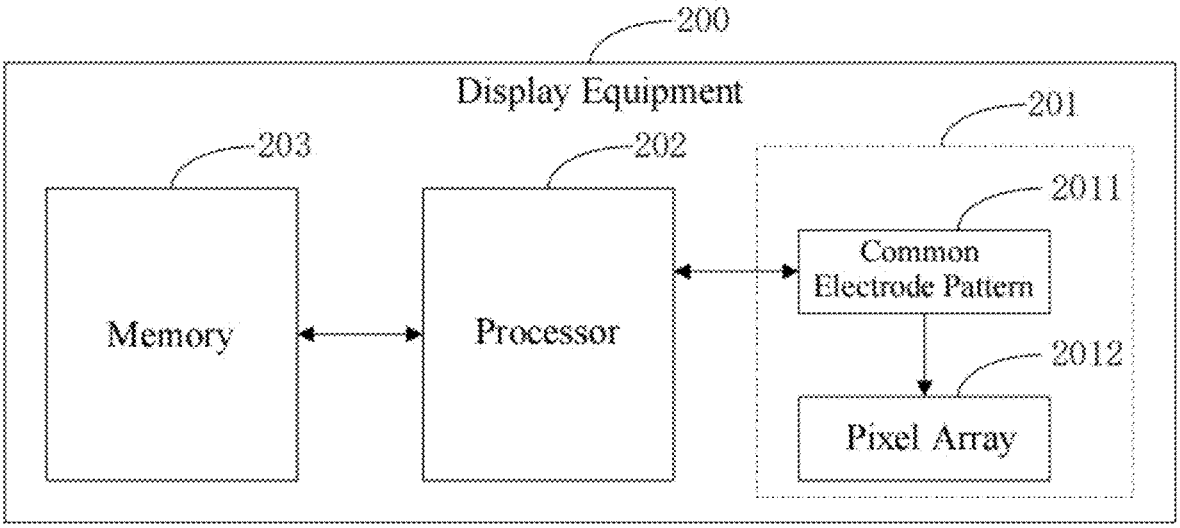
FIG. 21 is a schematic structural diagram of a display equipment in accordance with an embodiment of the present application.

As shown in FIG. 21, an embodiment of the present application provides a display equipment 200. The display equipment may include: an array substrate 201, at least one processor 202 (only one is shown in FIG. 21), a memory 203, and a computer program stored in the memory 203 and available at running on at least one processor 202. The array substrate 201 may include a common electrode pattern 2011 and a pixel array 2012. The steps of the driving method according to any of the above method embodiments are implemented when the the computer program is executed by the processor 202.

In an application, the display equipment may include, but is not limited to, an array substrate, a processor, and a memory. Those skilled in the art can understand that FIG. 21 is only an example of the display equipment, and does not constitute a limitation on the display equipment. The display equipment may include more or less components than the one shown in the figures, or combine some components, or different components, such as input and output devices, network access devices, and the like.

In an application, the display equipment may be a thin film transistor liquid crystal display (TFT-LCD) equipment, a liquid crystal display (LCD) equipment, an organic electroluminesence display (OLED) equipment, quantum dot light emitting diodes (QLED), and other display equipment.

In an application, the processor may be a central processing unit (CPU). The processor may also be other general-purpose processors, digital signal processors (DSP), application specific integrated circuits (ASIC), field-programmable gate array (FPGA) or other programmable logic devices, discrete gate or transistor logic devices, discrete hardware components, etc. For example, the processor may be a timing controller (TCON). The general-purpose processor may be a microprocessor. Or the processor may be any conventional processor or the like.

In an application, the memory, in some embodiments, may be an internal storage unit of the display equipment, such as a hard disk or a memory of the display equipment. In other embodiments, the memory may also an external storage device of the display equipment, for example, a plug-in hard disk equipped on the display equipment, a smart media card (SMC), a secure digital (SD) card, a flash memory card, etc. The memory may also include both an internal storage unit and an external storage device of the display equipment. The memory may be used to store an operation system, application programs, a boot loader, data, and other programs, such as program codes of computer programs, and the like. The memory may also be used to temporarily store data that has been or will be output.

It should be noted that the information exchange, execution process and other contents between the above-mentioned devices/units are based on the same concept as the method embodiments of the present application. For specific functions and technical effects, references can be made to the above method embodiments, which will not be repeated herein.

It can be clearly understood for those skilled in the art that, for the convenience and brevity of the description, the division of the above functional units is illustrated as an example. In practical applications, the above functions may be assigned by different functional units according to the needs, that is, the internal structure of the device may be divided into different functional units to complete all or part of the functions described above. Each functional unit in the embodiment may be integrated in one processing unit, or each unit may exist physically alone, or two or more units may be integrated in one unit, and the above-mentioned integrated units may be implemented in the form of hardware, and may also be implemented in the form of software functional units. In addition, specific names of the functional units are used only for the convenience of distinguishing from each other, and are not used to limit the protection scope of the present application. For the specific working process of the units in the above system, reference may be made to the corresponding process in the foregoing method embodiments, which will not be repeated herein.

In accordance with an embodiment of the present application, a computer-readable storage medium is also provided, in which a computer program is stored, and when the computer program is executed by a timing controller, the steps in the foregoing driving method embodiments can be implemented.

In accordance with an embodiment of the present application, a computer program product is also provided. When the computer program product runs on a display equipment, the display equipment can implement the steps in the foregoing driving method embodiments.

The integrated unit, if implemented in the form of a software functional unit and sold or used as an independent product, may be stored in a computer-readable storage medium. Based on this understanding, the implementation of all or part of the processes in the above methods embodiments of the present application, can be completed by instructing the relevant hardware through a computer program, and the computer program may be stored in a computer-readable storage medium. When the computer program is executed by a timing controller, the steps in each of the foregoing method embodiments can be implemented. The computer program includes computer program codes, and the computer program codes may be in the form of source codes, object codes, executable file or some intermediate form, and the like. The computer-readable medium may include at least: any entity or device capable of carrying the computer program codes to the display equipment, a recording medium, a computer memory, a read-only memory (ROM), a random-access memory (RAM), electrical carrier signals, telecommunication signals, and a software distribution media. For example, a U disk, a mobile hard disk, a disk or a CD, etc.

In the foregoing embodiments, the description of each embodiment has its own emphasis. For parts that are not recorded or described in detail in a certain embodiment, reference may be made to the relevant descriptions of other embodiments.

It will be appreciated for those of ordinary skill in the art that each exemplary unit and algorithm step described in conjunction with the embodiments disclosed herein can be implemented in electronic hardware, or a combination of computer software and electronic hardware. Whether these functions are performed in hardware or software depends on the specific application and design constraints in the embodiments. Skilled artisans may implement the described functionality using different methods for each particular application, but such implementations should not be considered beyond the scope of the present application.

It should be understood that the disclosed apparatus and method in the embodiments of the present application may be implemented in other manners. For example, the apparatus embodiments described above are only illustrative. For example, the division of the units is only a logical function division. In actual implementation, other division methods may be presented. For example, multiple units or components may be combined or integrated into another system, or some features may be ignored, or not implemented. In addition, the shown or discussed mutual coupling or direct coupling or communication connection may be indirect coupling or communication connection through some interfaces, devices or units, and may be in electrical, mechanical or other forms.

The units described as separate components may or may not be physically separated, and components displayed as units may or may not be physical units, that is, may be located in one place, or may be distributed to multiple network units. Some or all of the units may be selected according to actual needs to achieve the purpose of the solution in this embodiment.

The above-mentioned embodiments are only used to illustrate rather than limit the schemes of the present application. Although this disclosure has been described in detail with reference to the above-mentioned embodiments, it should be understood for those of ordinary skill in the art that the schemes in the above-mentioned embodiments may be modified, or some features in the schemes may be equivalently replaced. These modifications or replacements do not make the essence of the corresponding schemes deviate from the spirit and scope of the schemes in the embodiments of the present application, and thus should all be included within the protection scope of the present application.

What is claimed is:

1. A common electrode pattern, comprising:

a first common electrode unit, comprising:

a first common electrode line, configured to be arranged along a first non-display area of an array substrate; and a plurality of second common electrode lines, electrically connected to the first common electrode line, configured to be arranged according to an arrangement of all positive-polarity pixels in a display area of the array substrate, and to provide a common voltage to all the positive-polarity pixels; and a second common electrode unit, comprising:

a third common electrode line, configured to be arranged along a second non-display area of the array substrate; and a plurality of fourth common electrode lines, electrically connected to the third common electrode line, configured to be arranged according to an arrangement of all negative-polarity pixels in the display area, and to provide a common voltage to all the negative-polarity pixels, wherein the first common electrode unit is configured to adjust the common voltage of all the positive-polarity pixels in the second vertical blank interval, and the second common electrode unit is configured to adjust the common voltage of all the negative-polarity pixels in the second vertical blank interval, in case that the refresh frequency of the current frame is different from a refresh frequency of a reference frame, to enable a difference between a first voltage difference and a second voltage difference to be within a preset voltage-difference range; and wherein the first voltage difference is a root mean square of differences between a common voltage and a pixel voltage of all pixels in a first vertical blank interval when the reference frame is displayed, and the second voltage difference is a root mean square of differences between the common voltage and the pixel voltage of all the pixels in the second vertical blank interval when the current frame is displayed.

2. The common electrode pattern according to claim 1, wherein a polarity inversion driving mode of a pixel array in the display area is an N line-inversion driving mode, and the N line-inversion driving mode is either an N row-inversion driving mode or an N column-inversion driving mode, wherein N is 1 or 2;

the plurality of second common electrode lines are configured to be arranged according to an arrangement of all lines of positive-polarity pixels, each of the plurality of second common electrode lines is configured to provide the common voltage to a line of positive-polarity pixels, wherein a line of is either a row of or a column of; and the plurality of fourth common electrode lines are configured to be arranged according to an arrangement of all lines of negative-polarity pixels, and each of the plurality of fourth common electrode lines is configured to provide the common voltage to a line of negative-polarity pixels.

3. The common electrode pattern according to claim 1, wherein a polarity inversion driving mode of a pixel array in the display area is a dot-inversion driving mode, and the arrangement of the pixel array is that adjacent pixels of any pixel in a row direction and a column direction are pixels of a different polarity, adjacent pixels in a first oblique direction and a second oblique direction are pixels of a same polarity, an included angle between the first oblique direction and the column direction is in a range from 0° to 90°, and an included angle between the second oblique direction and the row direction is in a range from 0° to 90°;

the plurality of second common electrode lines are configured to be arranged according to the arrangement of all the positive-polarity pixels, and each of the plurality of second common electrode lines is configured to provide the common voltage to a line of positive-polarity pixels in an oblique direction, the oblique direction is any one of the first oblique direction and the second oblique direction; and the plurality of fourth common electrode lines are configured to be arranged according to the arrangement of all the negative-polarity pixels, and each of the plurality of fourth common electrode lines is configured to provide the common voltage to a line of negative-polarity pixels in the oblique direction.

4. The common electrode pattern according to claim 1, wherein a polarity inversion driving mode of a pixel array in the display area is a 1+2 line-inversion driving mode, and the arrangement of the pixel array is that adjacent pixels of any pixel in a row direction are pixels of a different polarity, and adjacent pixels in a column direction include a pixel of a same polarity and a pixel of a different polarity;

the plurality of second common electrode lines are configured to be arranged according to the arrangement of all the positive-polarity pixels, and each of the plurality of second common electrode lines is configured to provide the common voltage to a line of positive-polarity pixels adjacent in sequence in the column direction and an oblique direction, the oblique direction is any one of a first oblique direction and a second oblique direction, an included angle between the first oblique direction and the column direction is in a range from 0° to 90°, and an included angle between the second oblique direction and the row direction is in a range from 0° to 90°; and the plurality of fourth common electrode lines are configured to be arranged according to the arrangement of all the negative-polarity pixels, and each of the plurality of fourth common electrode lines is configured to provide the common voltage to a line of negative-polarity pixels adjacent in sequence in the column direction and the oblique direction.

5. A driving method, comprising:

providing a common electrode pattern, the common electrode pattern comprising:

a first common electrode unit, comprising:

a first common electrode line, configured to be arranged along a first non-display area of an array substrate; and a plurality of second common electrode lines, electrically connected to the first common electrode line, configured to be arranged according to an arrangement of all positive-polarity pixels in a display area of the array substrate, and to provide a common voltage to all the positive-polarity pixels; and a second common electrode unit, comprising:

a third common electrode line, configured to be arranged along a second non-display area of the array substrate; and a plurality of fourth common electrode lines, electrically connected to the third common electrode line, configured to be arranged according to an arrangement of all negative-polarity pixels in the display area, and to provide a common voltage to all the negative-polarity pixels;

acquiring a refresh frequency of a current frame; and adjusting the common voltage of all the positive-polarity pixels in a second vertical blank interval through a first common electrode unit, and adjusting the common voltage of all the negative-polarity pixels in the second vertical blank interval through the second common electrode unit, in case that the refresh frequency of the current frame is different from a refresh frequency of a reference frame, to enable a difference between a first voltage difference and a second voltage difference to be within a preset voltage-difference range;

wherein the first voltage difference is a root mean square of differences between a common voltage and a pixel voltage of all pixels in a first vertical blank interval when the reference frame is displayed, and the second voltage difference is a root mean square of differences between the common voltage and the pixel voltage of all the pixels in the second vertical blank interval when the current frame is displayed.

6. The driving method according to claim 5, wherein the adjusting of the common voltage of all the positive-polarity pixels in the second vertical blank interval through the first common electrode unit comprises:

adjusting the common voltage of all the positive-polarity pixels in the second vertical blank interval in a vertical change manner through the first common electrode unit, so that the common voltage changes vertically in the second vertical blank interval;

or alternatively, adjusting the common voltage of all the positive-polarity pixels in the second vertical blank interval in a linear change manner through the first common electrode unit, so that the common voltage changes linearly in the second vertical blank interval;

or alternatively, adjusting the common voltage of all the positive-polarity pixels in the second vertical blank interval in an oscillation change manner through the first common electrode unit, so that the common voltage oscillates and changes in the second vertical blank interval;

or alternatively, adjusting the common voltage of all the positive-polarity pixels in the second vertical blank interval in a step-by-step change manner through the first common electrode unit, so that the common voltage changes stepwise in the second vertical blank interval.

7. The driving method according to claim 5, wherein the adjusting of the common voltage of all the negative-polarity pixels in the second vertical blank interval by the second common electrode unit comprises:

adjusting the common voltage of all the negative-polarity pixels in the second vertical blank interval in a vertical change manner through the second common electrode unit, so that the common voltage changes vertically in the second vertical blank interval;

or alternatively, adjusting the common voltage of all the negative-polarity pixels in the second vertical blank interval in a linear change manner through the second common electrode unit, so that the common voltage changes linearly in the second vertical blank interval;

or alternatively, adjusting the common voltage of all the negative-polarity pixels in the second vertical blank interval in an oscillation change manner through the second common electrode unit, so that the common voltage oscillates and changes in the second vertical blank interval;

or alternatively, adjusting the common voltage of all the negative-polarity pixels in the second vertical blank interval in a step-by-step change manner through the second common electrode unit, so that the common voltage changes stepwise in the second vertical blank interval.

8. The driving method according to claim 5, wherein the adjusting of the common voltage of all the positive-polarity pixels in a second vertical blank interval through a first common electrode unit, and adjusting the common voltage of all the negative-polarity pixels in the second vertical blank interval through the second common electrode unit, in case that the refresh frequency of the current frame is different from a refresh frequency of a reference frame, comprises:

decreasing the common voltage of all the positive-polarity pixels in the second vertical blank interval through the first common electrode unit, and increasing the common voltage of all the negative-polarity pixels in the second vertical blank interval through the second common electrode unit, in case that the refresh frequency of the current frame is smaller than the refresh frequency of the reference frame; and increasing the common voltage of all the positive-polarity pixels in the second vertical blank interval through the first common electrode unit, and decreasing the common voltage of all the negative-polarity pixels in the second vertical blank interval through the second common electrode unit, in case that the refresh frequency of the current frame is greater than the refresh frequency of the reference frame.

9. The driving method according to claim 5, wherein a range for adjusting the common voltage is between an initial common voltage and a target common voltage, and a difference between the initial common voltage and the target common voltage is equal to a third voltage difference, and the third voltage difference is a difference between the initial pixel voltage and a pixel voltage at an end time point of the second vertical blank interval.

10. A display equipment, comprising:

an array substrate, comprising:

a pixel array; and a common electrode pattern, comprising:

a first common electrode unit, comprising:

a first common electrode line, configured to be arranged along a first non-display area of an array substrate; and a plurality of second common electrode lines, electrically connected to the first common electrode line, configured to be arranged according to an arrangement of all positive-polarity pixels in a display area of the array substrate, and to provide a common voltage to all the positive-polarity pixels; and a second common electrode unit, comprising:

a third common electrode line, configured to be arranged along a second non-display area of the array substrate; and a plurality of fourth common electrode lines, electrically connected to the third common electrode line, configured to be arranged according to an arrangement of all negative-polarity pixels in the display area, and to provide a common voltage to all the negative-polarity pixels; and a memory, a processor and a computer program stored in the memory and executable on the processor, wherein the computer program, when being executed by the processor, causes the display equipment to perform operations comprising:

acquiring a refresh frequency of a current frame; and adjusting the common voltage of all the positive-polarity pixels in a second vertical blank interval through a first common electrode unit, and adjusting the common voltage of all the negative-polarity pixels in the second vertical blank interval through the second common electrode unit, in case that the refresh frequency of the current frame is different from a refresh frequency of a reference frame, to enable a difference between a first voltage difference and a second voltage difference to be within a preset voltage-difference range;

wherein the first voltage difference is a root mean square of differences between a common voltage and a pixel voltage of all pixels in a first vertical blank interval when the reference frame is displayed, and the second voltage difference is a root mean square of differences between the common voltage and the pixel voltage of all the pixels in the second vertical blank interval when the current frame is displayed.

11. The driving method according to claim 6, wherein a range for adjusting the common voltage is between an initial common voltage and a target common voltage, and a difference between the initial common voltage and the target common voltage is equal to a third voltage difference, and the third voltage difference is a difference between the initial pixel voltage and a pixel voltage at an end time point of the second vertical blank interval.

12. The driving method according to claim 7, wherein a range for adjusting the common voltage is between an initial common voltage and a target common voltage, and a difference between the initial common voltage and the target common voltage is equal to a third voltage difference, and the third voltage difference is a difference between the initial pixel voltage and a pixel voltage at an end time point of the second vertical blank interval.

13. The driving method according to claim 8, wherein a range for adjusting the common voltage is between an initial common voltage and a target common voltage, and a difference between the initial common voltage and the target common voltage is equal to a third voltage difference, and the third voltage difference is a difference between the initial pixel voltage and a pixel voltage at an end time point of the second vertical blank interval.

14. The display equipment according to claim 10, wherein a polarity inversion driving mode of the pixel array in the display area is an N line-inversion driving mode, and the N line-inversion driving mode is either an N row-inversion driving mode or an N column-inversion driving mode, wherein N is 1 or 2;

the plurality of second common electrode lines are configured to be arranged according to an arrangement of all lines of positive-polarity pixels, each of the plurality of second common electrode lines is configured to provide the common voltage to a line of positive-polarity pixels, wherein a line of is either a row of or a column of; and the plurality of fourth common electrode lines are configured to be arranged according to an arrangement of all lines of negative-polarity pixels, and each of the plurality of fourth common electrode lines is configured to provide the common voltage to a line of negative-polarity pixels.

15. The display equipment according to claim 10, wherein a polarity inversion driving mode of the pixel array in the display area is a dot-inversion driving mode, and the arrangement of the pixel array is that adjacent pixels of any pixel in a row direction and a column direction are pixels of a different polarity, adjacent pixels in a first oblique direction and a second oblique direction are pixels of a same polarity, an included angle between the first oblique direction and the column direction is in a range from 0° to 90°, and an included angle between the second oblique direction and the row direction is in a range from 0° to 90°;

the plurality of second common electrode lines are configured to be arranged according to the arrangement of all the positive-polarity pixels, and each of the plurality of second common electrode lines is configured to provide the common voltage to a line of positive-polarity pixels in an oblique direction, the oblique direction is any one of the first oblique direction and the second oblique direction;

the plurality of fourth common electrode lines are configured to be arranged according to the arrangement of all the negative-polarity pixels, and each of the plurality of fourth common electrode lines is configured to provide the common voltage to a line of negative-polarity pixels in the oblique direction.

16. The display equipment according to claim 10, wherein a polarity inversion driving mode of the pixel array in the display area is a 1+2 line-inversion driving mode, and the arrangement of the pixel array is that adjacent pixels of any pixel in a row direction are pixels of a different polarity, and adjacent pixels in a column direction include a pixel of a same polarity and a pixel of a different polarity;

the plurality of second common electrode lines are configured to be arranged according to the arrangement of all the positive-polarity pixels, and each of the plurality of second common electrode lines is configured to provide the common voltage to a line of positive-polarity pixels adjacent in sequence in the column direction and an oblique direction, the oblique direction is any one of a first oblique direction and a second oblique direction, an included angle between the first oblique direction and the column direction is in a range from 0° to 90°, and an included angle between the second oblique direction and the row direction is in a range from 0° to 90°; and the plurality of fourth common electrode lines are configured to be arranged according to the arrangement of all the negative-polarity pixels, and each of the plurality of fourth common electrode lines is configured to provide the common voltage to a line of negative-polarity pixels adjacent in sequence in the column direction and the oblique direction.

17. The display equipment according to claim 10, wherein the operation of adjusting the common voltage of all the positive-polarity pixels in the second vertical blank interval through the first common electrode unit comprises:

adjusting the common voltage of all the positive-polarity pixels in the second vertical blank interval in a vertical change manner through the first common electrode unit, so that the common voltage changes vertically in the second vertical blank interval;

or alternatively, adjusting the common voltage of all the positive-polarity pixels in the second vertical blank interval in a linear change manner through the first common electrode unit, so that the common voltage changes linearly in the second vertical blank interval;

or alternatively, adjusting the common voltage of all the positive-polarity pixels in the second vertical blank interval in an oscillation change manner through the first common electrode unit, so that the common voltage oscillates and changes in the second vertical blank interval;

or alternatively, adjusting the common voltage of all the positive-polarity pixels in the second vertical blank interval in a step-by-step change manner through the first common electrode unit, so that the common voltage changes stepwise in the second vertical blank interval.

18. The display equipment according to claim 10, wherein the operation of adjusting the common voltage of all the negative-polarity pixels in the second vertical blank interval by the second common electrode unit comprises:

adjusting the common voltage of all the negative-polarity pixels in the second vertical blank interval in a vertical change manner through the second common electrode unit, so that the common voltage changes vertically in the second vertical blank interval;

or alternatively, adjusting the common voltage of all the negative-polarity pixels in the second vertical blank interval in a linear change manner through the second common electrode unit, so that the common voltage changes linearly in the second vertical blank interval;

or alternatively, adjusting the common voltage of all the negative-polarity pixels in the second vertical blank interval in an oscillation change manner through the second common electrode unit, so that the common voltage oscillates and changes in the second vertical blank interval;

or alternatively, adjusting the common voltage of all the negative-polarity pixels in the second vertical blank interval in a step-by-step change manner through the second common electrode unit, so that the common voltage changes stepwise in the second vertical blank interval.

19. The display equipment according to claim 10, wherein the operations of adjusting the common voltage of all the positive-polarity pixels in a second vertical blank interval through a first common electrode unit, and adjusting the common voltage of all the negative-polarity pixels in the second vertical blank interval through the second common electrode unit, in case that the refresh frequency of the current frame is different from a refresh frequency of a reference frame, comprise:

decreasing the common voltage of all the positive-polarity pixels in the second vertical blank interval through the first common electrode unit, and increasing the common voltage of all the negative-polarity pixels in the second vertical blank interval through the second common electrode unit, in case that the refresh frequency of the current frame is smaller than the refresh frequency of the reference frame; and increasing the common voltage of all the positive-polarity pixels in the second vertical blank interval through the first common electrode unit, and decreasing the common voltage of all the negative-polarity pixels in the second vertical blank interval through the second common electrode unit, in case that the refresh frequency of the current frame is greater than the refresh frequency of the reference frame.

20. The display equipment according to claim 10, wherein a range for adjusting the common voltage is between an initial common voltage and a target common voltage, and a difference between the initial common voltage and the target common voltage is equal to a third voltage difference, and the third voltage difference is a difference between the initial pixel voltage and a pixel voltage at an end time point of the second vertical blank interval.

* * * * *